US007215289B2

(12) United States Patent
Harano

(10) Patent No.: US 7,215,289 B2
(45) Date of Patent: May 8, 2007

(54) ANTENNA DEVICE AND PORTABLE RADIO TERMINAL

(75) Inventor: Nobuya Harano, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/150,256

(22) Filed: Jun. 13, 2005

(65) Prior Publication Data

US 2005/0275596 A1 Dec. 15, 2005

(30) Foreign Application Priority Data

Jun. 14, 2004 (JP) ..... 2004-176143
May 16, 2005 (JP) ..... 2005-142586

(51) Int. Cl.
*H01Q 1/24* (2006.01)

(52) U.S. Cl. ..... 343/702; 343/895

(58) Field of Classification Search ..... 343/700 MS, 343/702, 895, 833, 834
See application file for complete search history.

(56) References Cited

U.S. PATENT DOCUMENTS 5,583,521 A * 12/1996 Williams ..... 343/702
5,966,097 A 10/1999 Fukasawa et al.
6,657,595 B1 * 12/2003 Phillips et al. ..... 343/702
6,765,536 B2 * 7/2004 Phillips et al. ..... 343/702
6,876,331 B2 * 4/2005 Chiang et al. ..... 343/702
2005/0110692 A1 * 5/2005 Andersson ..... 343/702

FOREIGN PATENT DOCUMENTS

JP 62-161410 10/1987
JP 2004-56319 A 2/2004
WO WO 03/092118 A1 11/2003
WO WO 2004/025778 A1 3/2004

* cited by examiner

*Primary Examiner*—Tan Ho
(74) *Attorney, Agent, or Firm*—Sughrue Mion, PLLC

(57) ABSTRACT

An antenna device capable of being applied to a portable radio terminal and showing a good antenna characteristic regardless of the direction, and a portable radio terminal provided with the antenna device. The antenna device applied to a portable radio terminal whose housing length is equal to or more than λ/4 with respect to the wavelength λ of transmission-reception signals comprises an antenna element disposed on one end of the housing in the longitudinal direction in which at least one point of one end is connected to a signal wiring pattern on a substrate and the other end is an open end, and a parasitic element disposed on the same side of the housing as the antenna element in which one point of one end is connected to a ground wiring on the substrate and the other end is an open end, wherein the open end of the antenna element and the open end of the parasitic element are approximated to each other and capacity coupled.

25 Claims, 28 Drawing Sheets

(a)

(b)

(a)

(b)

(a)

(b)

(a)

(b)

ANTENNA DEVICE AND PORTABLE RADIO TERMINAL

BACKGROUND OF THE INVENTION

1. Field of the Invention

The present invention relates to an antenna device incorporated in a small-sized radio terminal, especially to an antenna device showing a good reception characteristic for high-frequency radio signals regardless of direction and a portable radio terminal provided with the antenna.

2. Description of the Prior Art

In recent years, a portable radio terminal typified by a mobile phone often uses radio signals in a high-frequency band. For instance, the frequency used in the third generation mobile phone goes beyond 2 GHz (gigahertz), and has a tendency to shift to the higher frequencies.

While a portable radio terminal is getting smaller and smaller, it has limitations for further miniaturization thereof from the operational point of view. Accordingly, as the higher frequencies are used, the length of a housing of a portable radio terminal often becomes beyond more than half of the wavelength $\lambda$, being $\lambda/2$.

As the length of the housing becomes longer with respect to the frequency, the radiation characteristic changes because of the current of the housing. Therefore, as represented by a half wave dipole antenna, it is not possible to have the uniform field emission pattern characteristic in a horizontal surface, and an abrupt drop (null point) appears in the horizontal surface.

In the case where the frequency is around 1 GHz, the wavelength is about 30 centimeter. Accordingly, when the electrical length including that of an antenna is equal to or less than $\lambda/2$, that is, when the length of the housing is equal to or less than 7.5 centimeter, and the electrical length of the antenna is equal to or less than $\lambda/4$, its field emission pattern characteristic becomes similar to that of the half wave dipole antenna. Thus, it is possible to have a relatively uniform field emission pattern characteristic in the horizontal surface.

However, in the case where the frequency is around 2 GHz, the wavelength is about 15 centimeter. Accordingly, even when the length of the housing of a radio terminal is around 10 centimeter, the electrical length including that of an antenna is about the same as or more than the wavelength. Thus, the field emission pattern characteristic does not become uniform because of the current of the housing, and an abrupt drop (null point) arises in the horizontal surface.

There has been the problem that it is not possible for a portable radio terminal to stably receive radio signals if the housing thereof has such a field emission characteristic and the reception characteristic changes depending on the direction of the terminal.

As a prior art document concerning an antenna of a portable radio terminal, Japanese utility model patent application laid-open No. 62-161410 discloses an antenna for a radio terminal, in which a platy radiating element is disposed parallel to the surface of a metallic housing of a radio terminal, one end of the platy radiating element is connected to the housing of the radio terminal and immobilized, a feeder cable is connected to a designated position on the platy radiating element, and a rod-shaped parasitic element is placed on the housing of the radio terminal.

This prior art realizes an antenna of a small size and also broadband characteristic by resonating the reverse F-shaped antenna of the platy radiating element and the rod-shaped parasitic element with each different resonance frequency.

Further, Japanese patent application laid-open No. 2004-56319 discloses a null-less antenna intended to fill in a null.

In the first prior art, while the radio terminal shows a good radiation characteristic in two frequency bands, the generation of a null has not been conceived. Therefore, when the art is applied to an antenna in a portable radio terminal, radio signals cannot be transmitted and received between a radio terminal and another radio terminal or a base station depending on the aspect of the radio terminal.

Also, the second prior art is so-called antenna array having a plurality of antennas, and therefore, it is difficult to apply the art to a portable radio terminal being required to be made smaller and lighter.

As above, it has not been provided an antenna device capable of being applied to a portable radio terminal and also showing a good radiation characteristic regardless of the direction of the terminal.

SUMMARY OF THE INVENTION

It is therefore an object of the present invention, in order to overcome the above mentioned problems, to provide an antenna device capable of being applied to a portable radio terminal and showing a good antenna characteristic regardless of direction, and a portable radio terminal provided with the antenna device.

To achieve the object mentioned above, in the first aspect of the present invention, an antenna device applied to a portable radio terminal whose housing length is equal to or more than $\lambda/4$ with respect to the wavelength $\lambda$ of transmission-reception signals comprises:

an antenna element disposed on one end of the housing in the longitudinal direction in which at least one point of one end is connected to a signal wiring pattern on a substrate and the other end is an open end; and a parasitic element disposed on the same side of housing as the antenna element in which one point of one end is connected to a ground wiring on the substrate and the other end is an open end;

wherein the open end of the antenna element and that of the parasitic element are approximated to each other and capacity coupled, and the antenna element, the parasitic element and the substrate are disposed forming a loop.

Preferably, in the first aspect of the present invention:

the antenna element is L-shaped or F-shaped and the parasitic element is reverse L-shaped or I-shaped;

at least one of the antenna element and the parasitic element is meandering-shaped in the vicinity of the open end in any configuration of the above described elements;

at least one of the antenna element and the parasitic element is helical-shaped in the vicinity of the open end, and more preferably, the open end of one of the antenna element and the parasitic element is inserted inside the other element whose open end is helical-shaped; or at least one of the antenna element and the parasitic element is configured with tabular conductor in the vicinity of the open end.

Preferably, in any configuration of the above described elements:

the open ends of the antenna element and the parasitic element are disposed in substantially the same plane as the substrate, and the distances from the substrate to the open end of the antenna element and to the open end of the parasitic element are different; or the open ends of the antenna element and the parasitic element are spaced from the substrate.

Preferably, in the first aspect of the present invention:

at least one of the antenna element and the parasitic element has two or more open ends;

at least one of the antenna element and the parasitic element is helical-shaped in the vicinity of at least one of the open ends, and more preferably, at least one of the open ends of one of the antenna element and the parasitic element is inserted inside the other element whose open end is helical-shaped; or at least one of the open ends of at least one of the antenna element and the parasitic element is configured with a tabular conductor.

Preferably, the open ends of the antenna element and the parasitic element are disposed in substantially the same plane as the substrate, and the distances from the substrate to the open end of the antenna element and to the open end of the parasitic element are different, or preferably, the open ends of the antenna element and the parasitic element are spaced from the substrate.

Preferably, in any configuration of the first aspect of the present invention:

connecting sections of the antenna element and the parasitic element to the substrate are platy;

the open ends of the antenna element and the parasitic element are platy;

a high dielectric material is disposed around the antenna element and the parasitic element;

at least one of the antenna element and the parasitic element is configured with the signal wiring pattern on the substrate; and a capacitive element or an inductive element is disposed between the open end of the antenna element and that of the parasitic element.

In the second aspect of the present invention, a portable radio terminal is provided with the antenna device having any one of configurations in the first aspect of the present invention.

Preferably in the second aspect of the present invention:

two housings are joined by a conjunction mechanism to be openable and closable;

the antenna element and the parasitic element contained in the housing are disposed in the vicinity of the conjunction mechanism, or the antenna element and the parasitic element contained in the housing are disposed at the place most distant from the conjunction mechanism; and the antenna element and the parasitic element contained in the housing are disposed alongside of an interior surface of the housing.

BRIEF DESCRIPTION OF THE DRAWINGS

The above and further objects and novel features of the invention will be more fully understood from the following detailed description when the same is read in connection with the accompanying drawings in which:

FIG. 9(*b*) is a diagram showing another disposition example of the antenna element and the parasitic element of the antenna device according to the fourth embodiment of the present invention;

FIG. 19(*b*) is a diagram showing the structure of an antenna device according to the twelfth embodiment of the present invention;

FIG. 20(*b*) is a diagram showing the structure of an antenna device according to the thirteenth embodiment of the present invention;

FIG. 22(*b*) is a diagram showing the structure of an antenna device according to the fifteenth embodiment of the present invention;

DETAILED DESCRIPTION OF THE PREFERRED EMBODIMENTS

Figure 1:
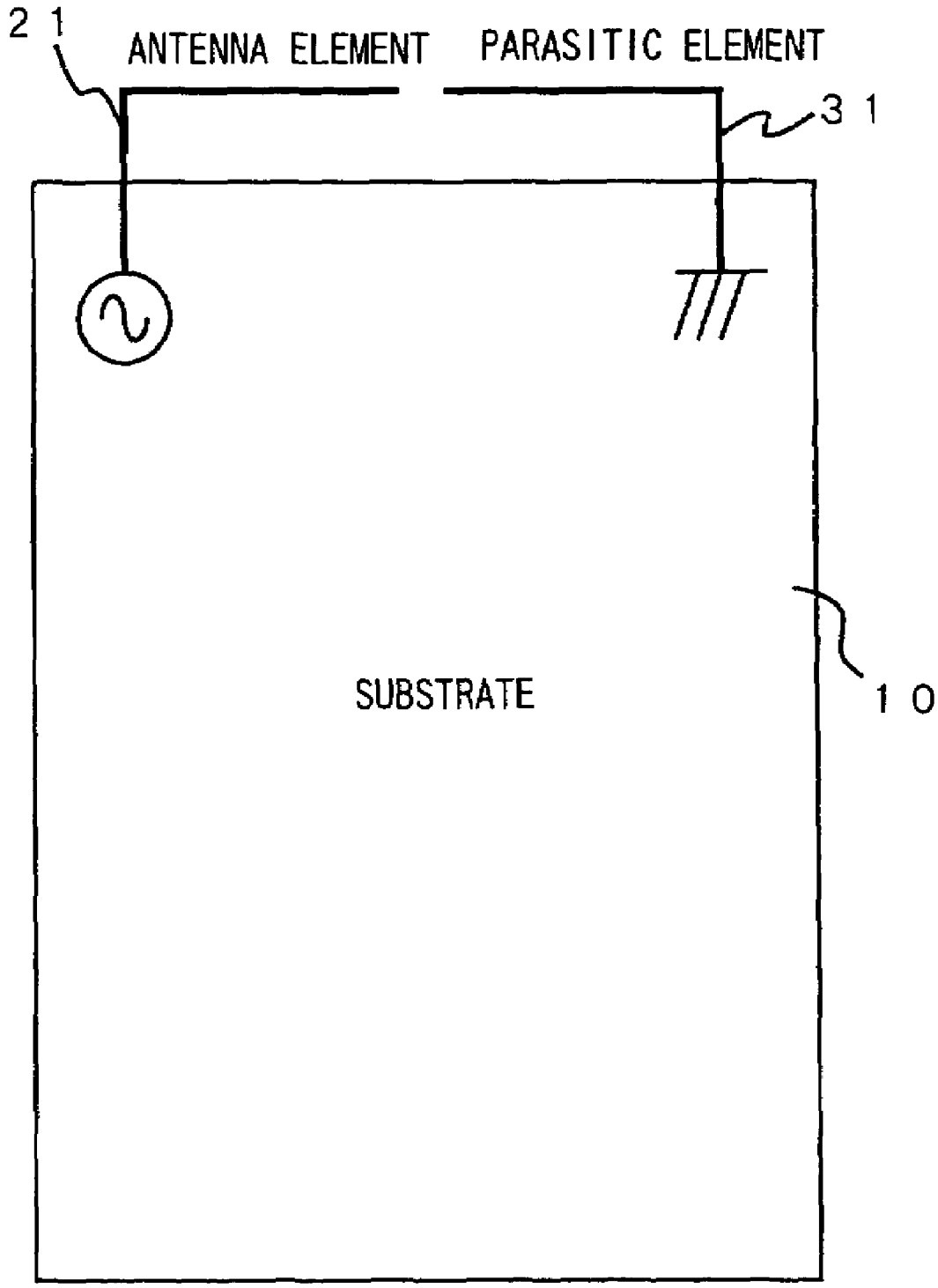
FIG. 1 is a diagram showing the structure of an antenna device according to the first embodiment of the present invention.
Figure 2:
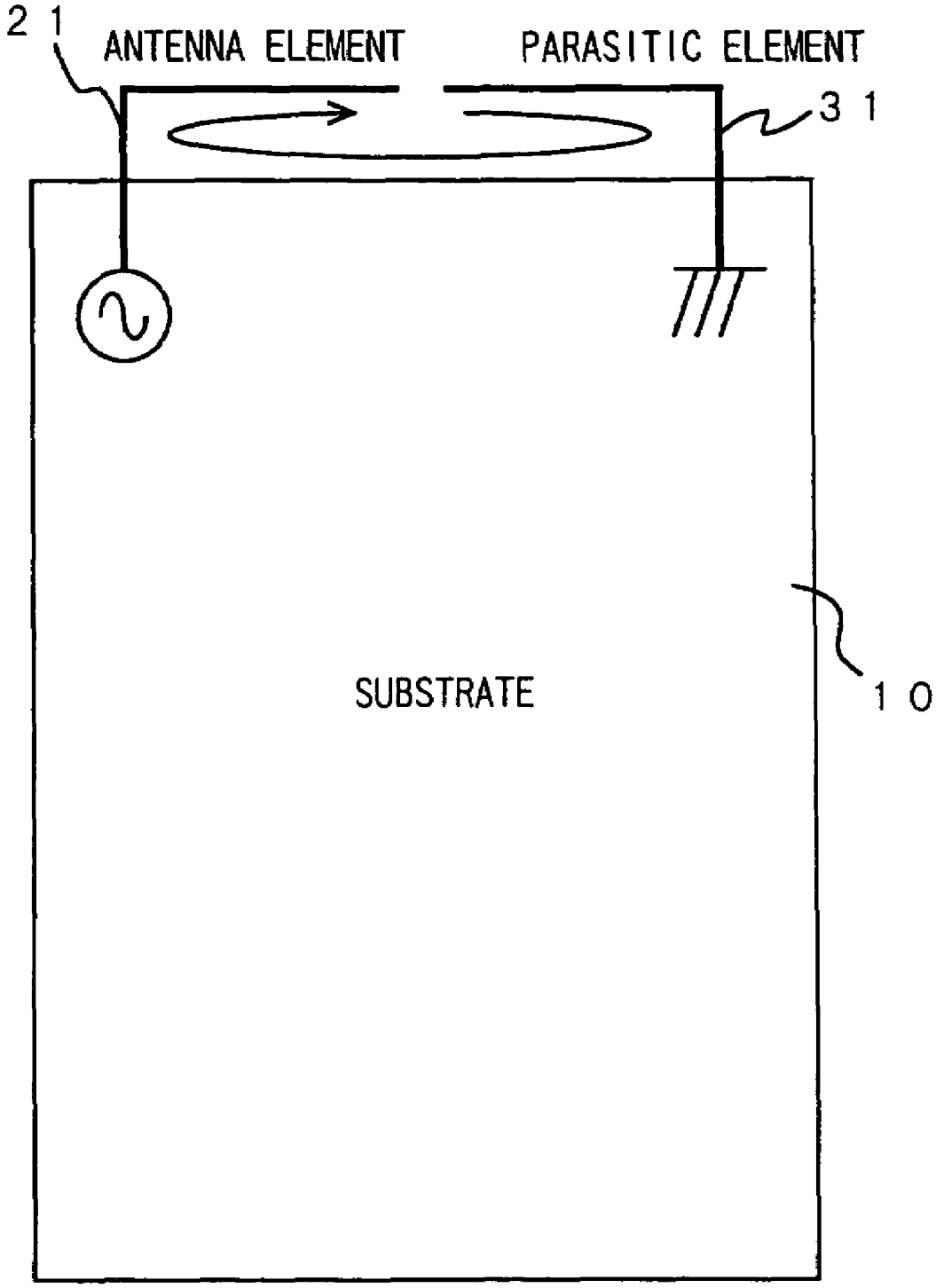
FIG. 2 is a diagram showing the operation of the antenna device according to the first embodiment of the present invention.

A description will be given of the first embodiment of the present invention. FIG. 1 is a diagram showing the structure of an antenna device according to this embodiment and FIG. 2 is a diagram showing the operation of the antenna device according to this embodiment. In the antenna device, an antenna element 21 and a parasitic element 31 are attached on one end of a substrate 10. At least one point of one end of the antenna element 21 is electrically connected to a signal wiring pattern on the substrate 10 and the other end of the antenna element is an open end. One end of the parasitic element 31 is connected to the ground of the substrate 10 and the other end of the parasitic element 31 is an open end.

The antenna element 21 and the parasitic element 31 are substantially L-shaped or reverse L-shaped and both of the open ends are disposed in proximity to each other and their fore-ends are in alignment.

When the open ends of the antenna element 21 and the parasitic element 31 are disposed as above, as shown in FIG. 2, high-frequency loop current passes through the ground of the substrate 10, the antenna element 21 and the parasitic element 31, and operates in the same manner as that of a loop antenna.

Figure 3:
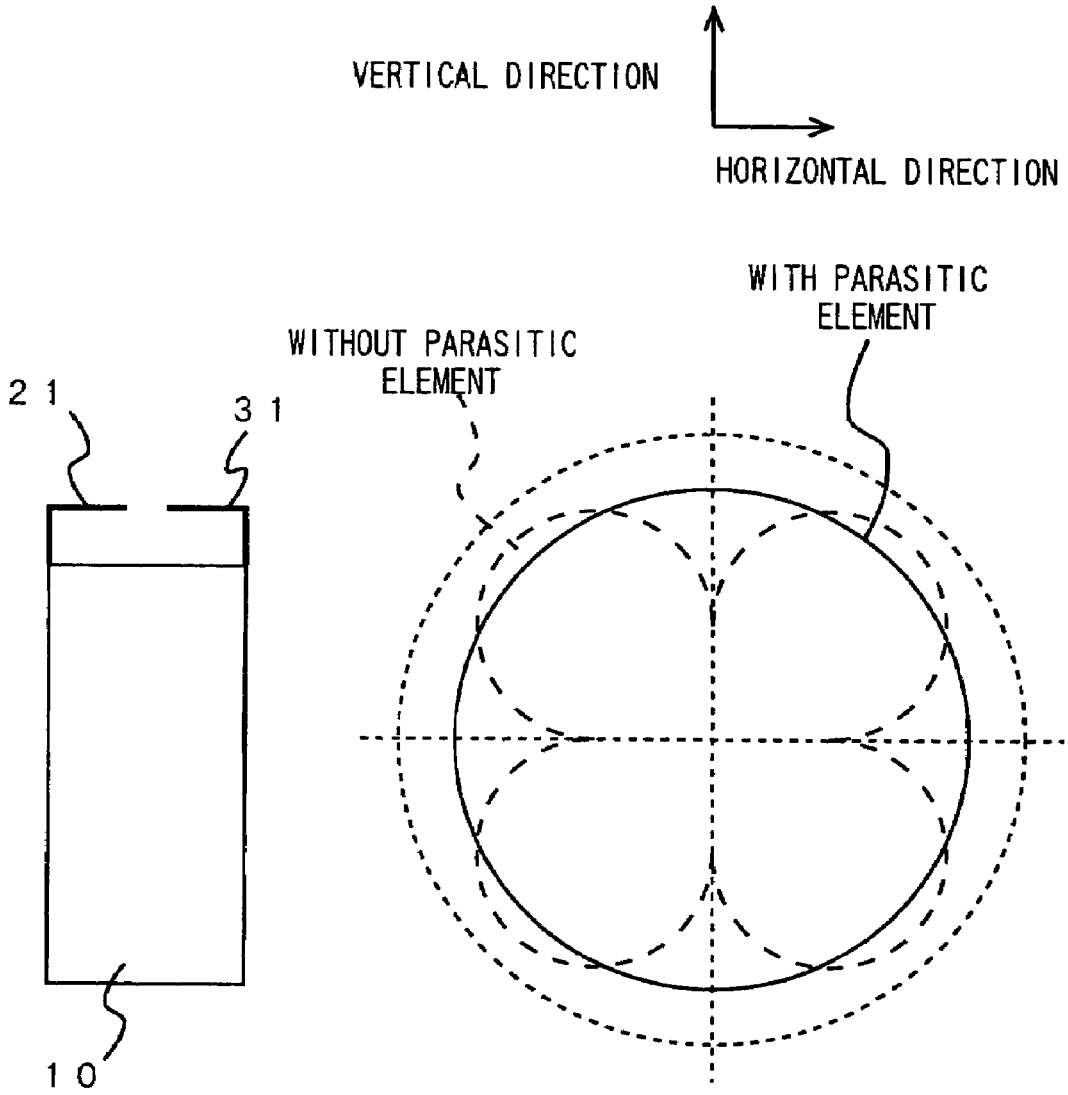
FIG. 3 is a diagram showing the field emission pattern characteristic of the antenna device of the first embodiment of the present invention.

FIG. 3 is a diagram showing the field emission pattern characteristic of the antenna device of this embodiment.

When the antenna device operates only with the L-shaped antenna 21, an abrupt drop of the field emission pattern characteristic arises in the horizontal surface, and also in the vertical direction. This means that when the antenna device operates only with the antenna element 21, the transmission-reception of signals could be disturbed depending on the direction.

On the other hand, as the antenna device of this embodiment, when the antenna device operates with the parasitic element 31, the drop in the horizontal direction and the vertical direction becomes smaller, and therefore the uniform field emission pattern characteristic can be obtained.

Figure 4:
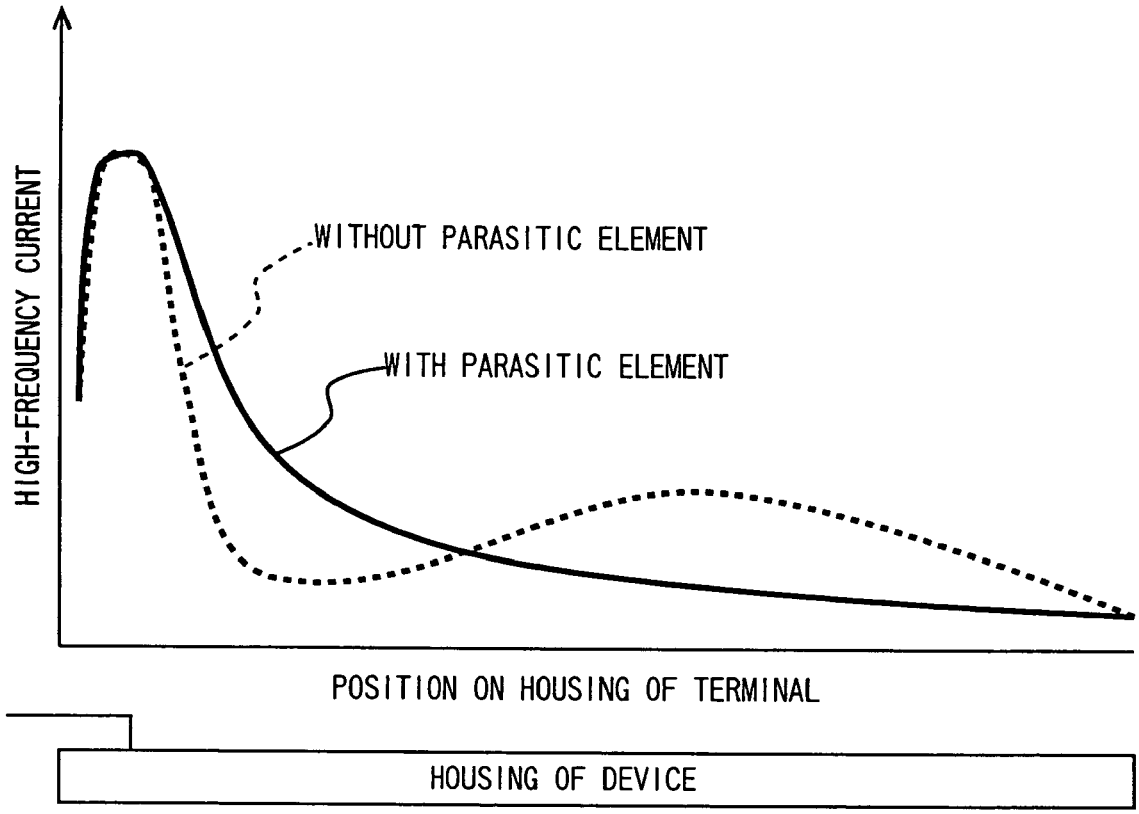
FIG. 4 is a graph showing the current distribution of a housing of a portable radio terminal applied by the antenna device according to the first embodiment of the present invention.

FIG. 4 is a graph showing the current distribution of a housing of a portable radio terminal to which the antenna device of this embodiment is applied. When the antenna device operates without the parasitic element 31, the current value of the housing reaches a peak at a point distant from the antenna element 21. That causes the deterioration of the field emission pattern characteristic. On the other hand, in the portable radio terminal to which the antenna device of this embodiment is applied, by placing the parasitic element 31, the current value of the housing does not reach a peak except at the site of the antenna device. In other words, with the parasitic element 31, smaller current passes through the ground plane of the substrate 10, and therefore, it is possible to prevent the deterioration of the field emission pattern characteristic (for example, as described above, the field emission pattern characteristic becomes papilionaceous and a null point arises) because of the influence of the current of the housing.

In a portable radio terminal, the direction in which the antenna device is used is depending on a user's posture for using the portable radio terminal. Therefore, it is necessary for the portable radio terminal to have approximately uniform field emission pattern characteristic in all directions to receive effectively radio waves transmitted from a distance.

As shown in FIG. 3, the antenna device of this embodiment shows the field emission pattern characteristic similar to that of an omnidirectional antenna. Incidentally, it is apparent that the antenna device of this embodiment has applicability to a portable radio terminal as is the case with a conventional antenna.

Figure 5:
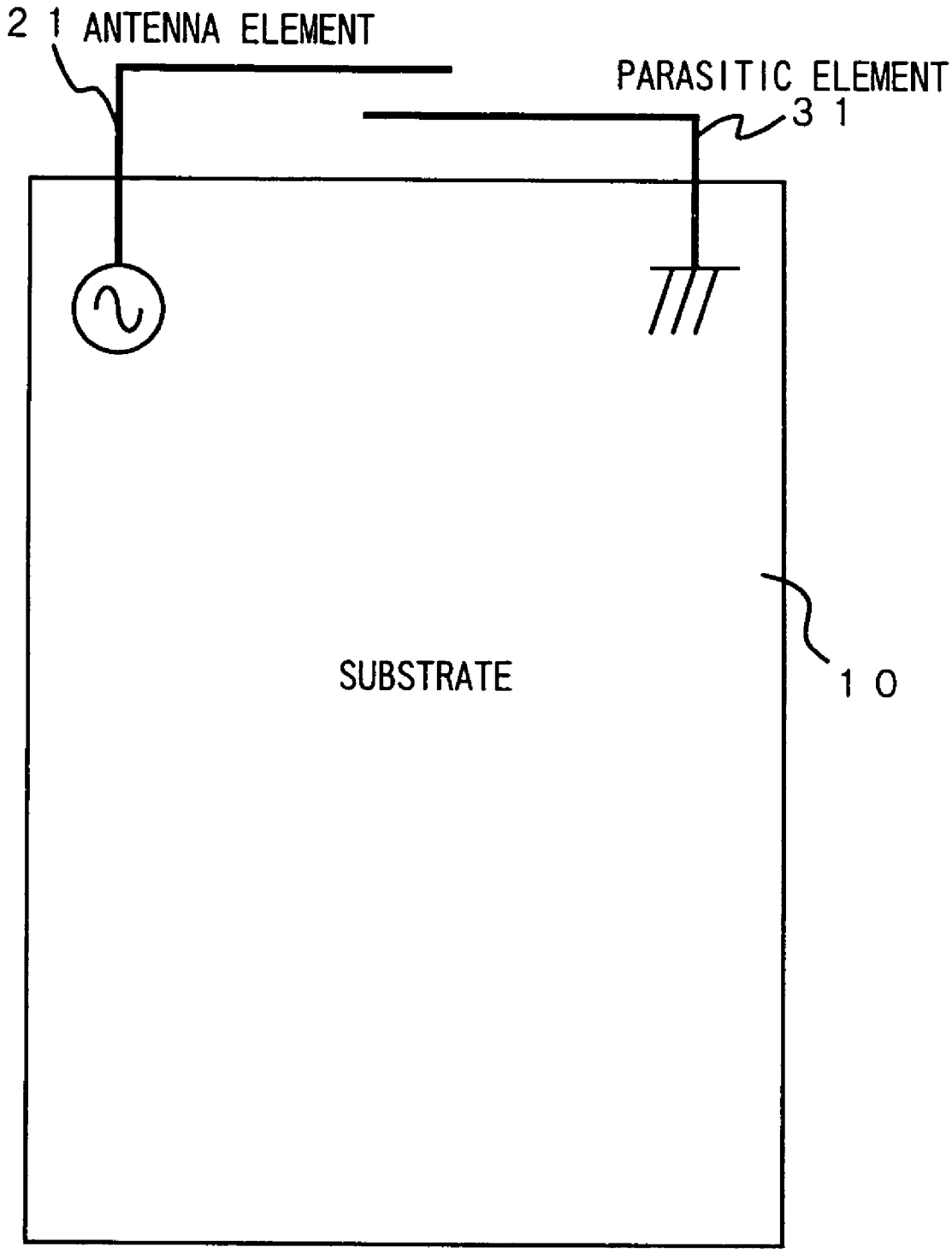
FIG. 5 is a diagram showing another example of the structure of the antenna device according to the first embodiment of the present invention.

Here, a description has been given of an example of the case that the ends of the antenna element 21 and the parasitic element 31 are disposed in close proximity to each other in alignment. However, the ends of the antenna element 21 and the parasitic element 31 are not needed to be in alignment, and as shown in FIG. 5, it is sufficient for the ends of the antenna element 21 and the parasitic element 31 to be disposed in close proximity to each other.

Figure 6:
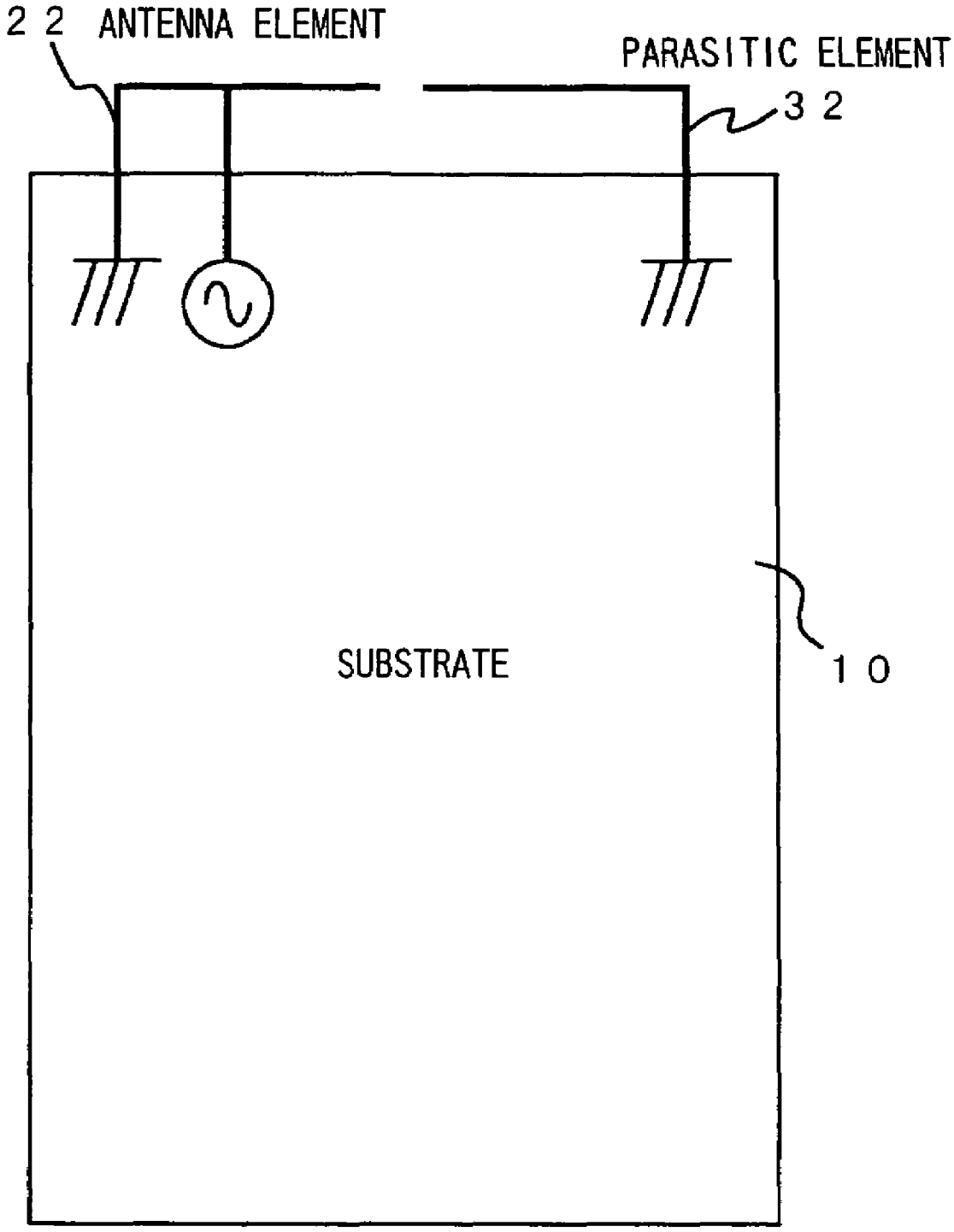
FIG. 6 is a diagram showing the structure of an antenna device according to the second embodiment of the present invention.

A description will be given of the second embodiment of the present invention. FIG. 6 is a diagram showing an antenna device of this embodiment. In the antenna device, the antenna element 22 and the parasitic element 32 are attached on one end of the substrate 10. The antenna element 22 is electrically connected to a signal wiring pattern on the substrate 10 at least at one point of one end and also to a ground pattern, and the other end of the antenna element 22 is an open end. One end of the parasitic element 32 is connected to the ground of the substrate 10 and the other end of the parasitic element 32 is an open end.

The antenna element 22 is substantially F-shaped or reverse F-shaped and the parasitic element 32 is substantially L-shaped or reverse L-shaped, and both ends are disposed in proximity in alignment.

When the open ends of the antenna element 22 and the parasitic element 32 are disposed as above, as is the case with the antenna device of the first embodiment, high-frequency loop current passes through the ground of the substrate 10, the antenna element 22 and the parasitic element 32, and operates in the same manner as that of a loop antenna.

The antenna device of this embodiment, same as that of the first embodiment, shows approximately uniform field emission pattern characteristic in all directions, and therefore, the antenna device of this embodiment has applicability to a portable radio terminal.

Figure 7:
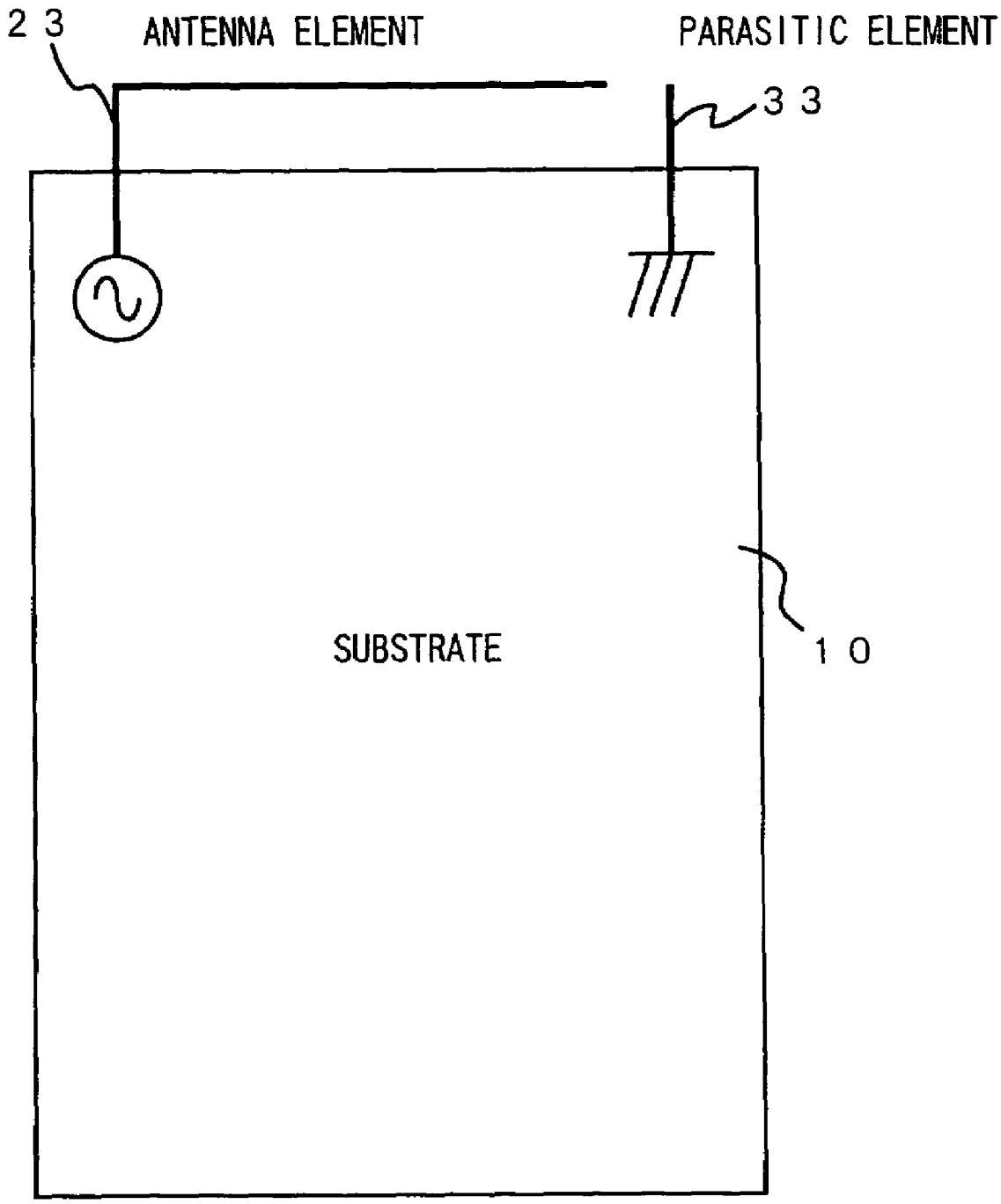
FIG. 7 is a diagram showing the structure of an antenna device according to the third embodiment of the present invention.

A description will be given of the third embodiment of the present invention. FIG. 7 is a diagram showing an antenna device of this embodiment. In the antenna device, the antenna element 23 and the parasitic element 33 are attached on one end of the substrate 10. At least one point of one end of the antenna element 23 is electrically connected to a signal wiring pattern on the substrate 10 and the other end of the antenna element 23 is an open end. One end of the parasitic element 33 is connected to the ground of the substrate 10 and the other end of the parasitic element 33 is an open end.

The antenna element 23 is substantially L-shaped or reverse L-shaped and the parasitic element 33 is substantially I-shaped, and both of the open ends are disposed in proximity.

When the open ends of the antenna element 23 and the parasitic element 33 are disposed as above, as is the case with the antenna device of the first embodiment, high-frequency loop current passes through the ground of the substrate 10, the antenna element 23 and the parasitic element 33, and operates in the same manner as that of a loop antenna.

The antenna device of this embodiment, same as that of the first embodiment, has approximately uniform field emission pattern characteristic in all directions, and therefore, the antenna device of this embodiment has applicability to a portable radio terminal.

Figure 8:
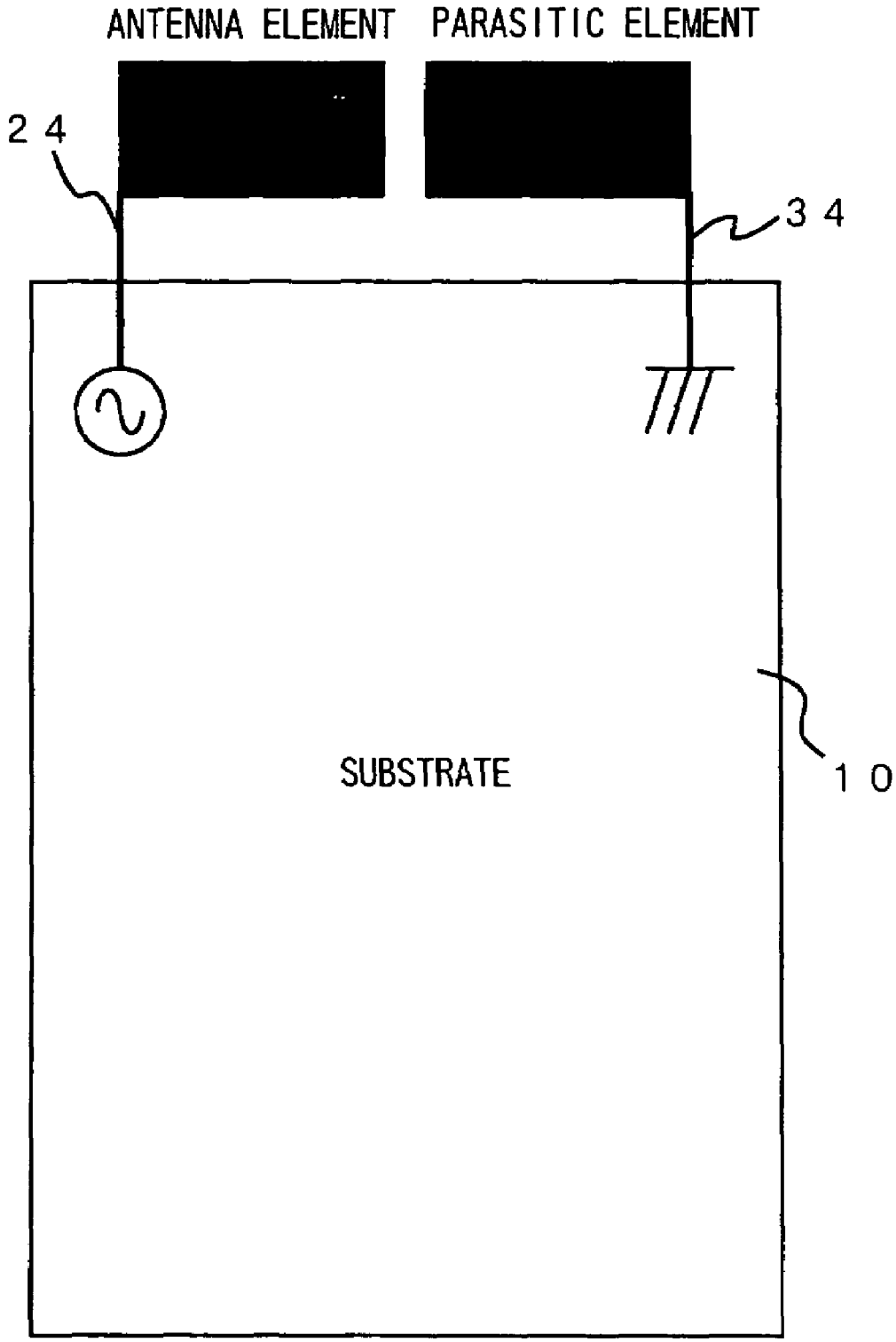
FIG. 8 is a diagram showing the structure of an antenna device according to the fourth embodiment of the present invention.
Figure 9:
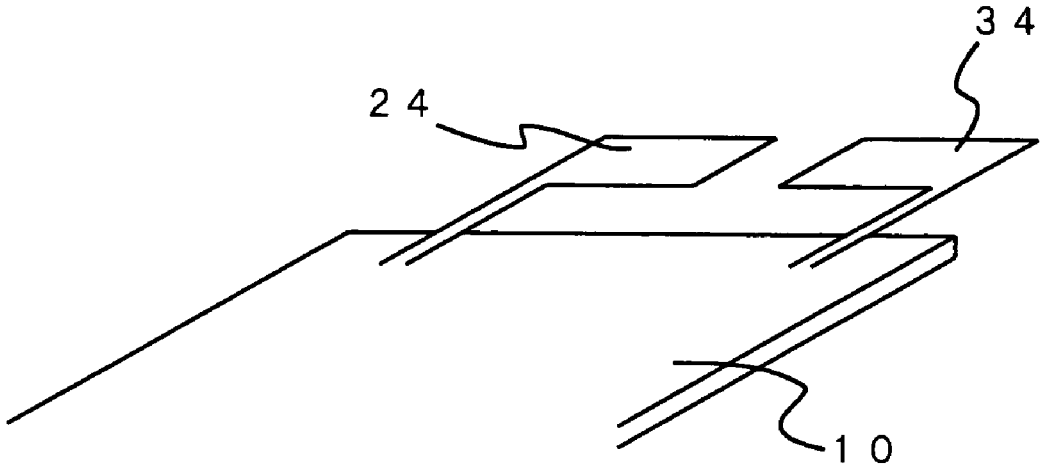
FIG. 9(*a*) is a diagram showing a disposition example of an antenna element and a parasitic element of the antenna device according to the fourth embodiment of the present invention.
Figure 9:
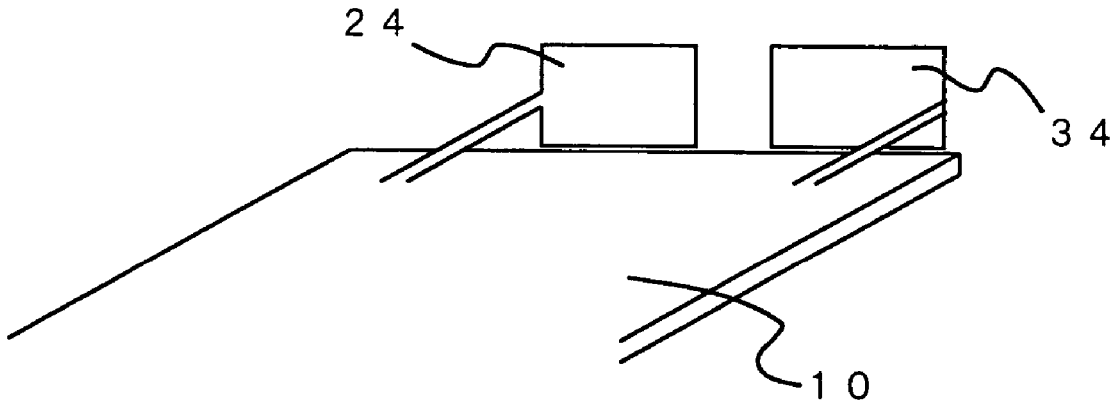

A description will be given of the fourth embodiment of the present invention. FIG. 8 is a diagram showing an antenna device of this embodiment. In the antenna device, the antenna element 24 and the parasitic element 34 are attached on one end of the substrate 10. At least one point of one end of the antenna element 24 is electrically connected to a signal wiring pattern on the substrate 10 and the other end of the antenna element 24 is an open end. One end of the parasitic element 34 is connected to the ground of the substrate 10 and the other end of the parasitic element 34 is an open end.

The antenna element 24 and the parasitic element 34 are substantially L-shaped or reverse L-shaped and both ends are configured with tabular conductors. The open ends of antenna element 24 and the parasitic element 34 are disposed in proximity to each other.

When the open ends of the antenna element 24 and the parasitic element 34 are disposed as above, as is the case with the antenna device of the first embodiment, high-frequency loop current passes through the ground of the substrate 10, the antenna element 24 and the parasitic element 34, and operates in the same manner as that of a loop antenna.

The antenna device of this embodiment, same as that of the first embodiment, has approximately uniform field emission pattern characteristic in all directions, and therefore, the antenna device of this embodiment has applicability to a portable radio terminal.

Incidentally, here, as shown in FIG. 8(*a*), a description has been given of an example of the case that conductors of the antenna element 24 and the parasitic element 34 and the substrate 10 are disposed in the same plane. On the other hand, as shown in FIG. 8(*b*), each conductor of the antenna element 24 and the parasitic element 34 may be disposed perpendicular to the substrate 10.

Figure 10:
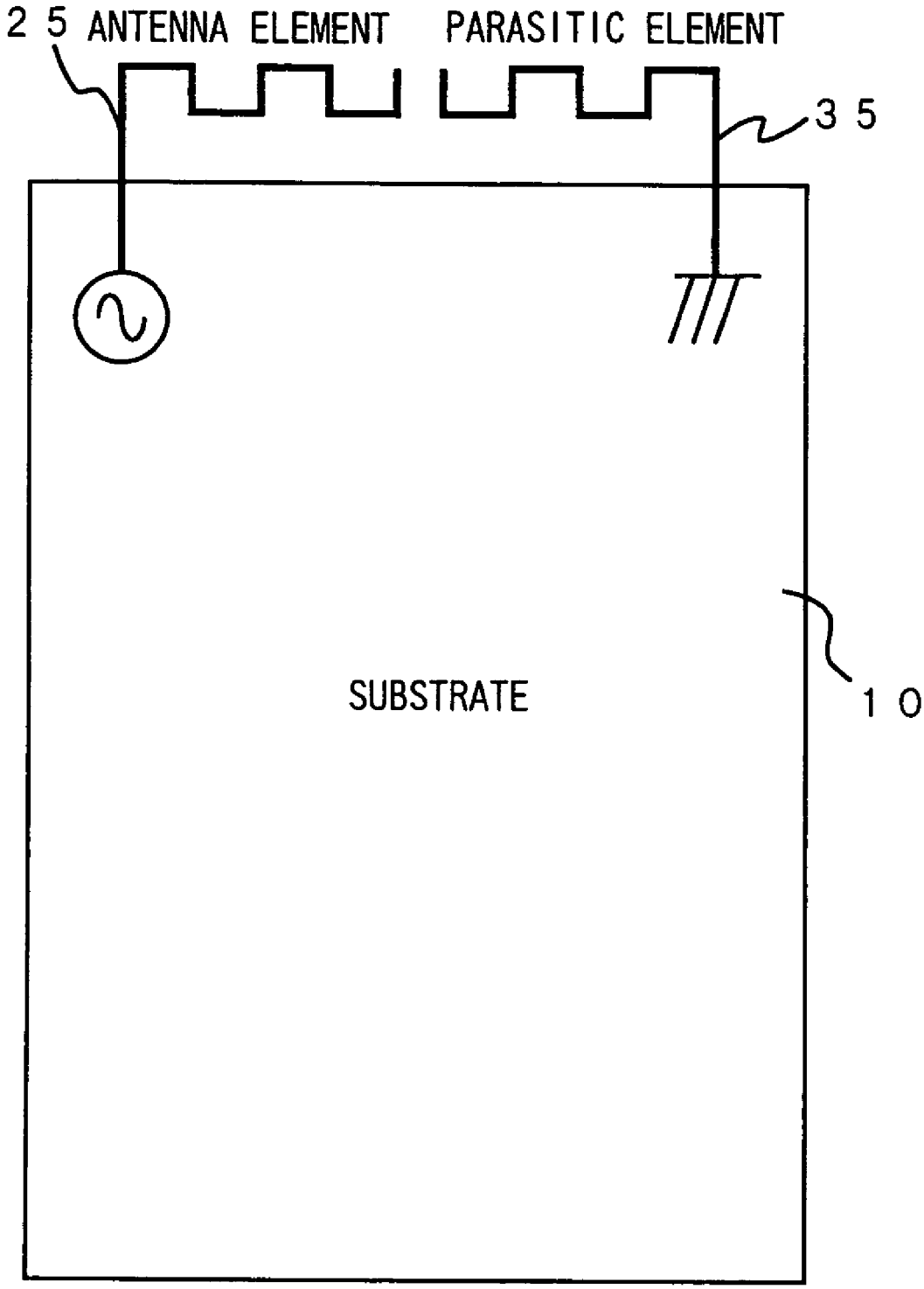
FIG. 10 is a diagram showing the structure of an antenna device according to the fifth embodiment of the present invention.

A description will be given of the fifth embodiment of the present invention. FIG. 10 is a diagram showing the structure of an antenna device of this embodiment. In the antenna device, the antenna element 25 and the parasitic element 35 are attached on one end of the substrate 10. At least one point of one end of the antenna element 25 is electrically connected to a signal wiring pattern on the substrate 10 and also a ground pattern, and the other end of the antenna element 25 is an open end. One end of the parasitic element 35 is connected to the ground of the substrate 10 and the other end of the parasitic element 35 is an open end.

The antenna element 25 and the parasitic element 35 are configured with conductors being meandering-shaped. The open ends of antenna element 25 and the parasitic element 35 are disposed in proximity to each other.

When the antenna element 25 and the parasitic element 35 are meandering-shaped, it is possible to lower their natural resonance frequencies. Therefore, the antenna device functions effectively as antenna over such low frequencies as the length of the antenna element 25 or the parasitic element 35 is equal to or less than $\lambda/4$ with respect to the wavelength $\lambda$.

When the open ends of the antenna element 25 and the parasitic element 35 are disposed in close proximity to each other, as is the case with the antenna device of the first embodiment, high-frequency loop current passes through the ground of the substrate 10, the antenna element 25 and the parasitic element 35, and operates in the same manner as that of a loop antenna.

Figure 11:
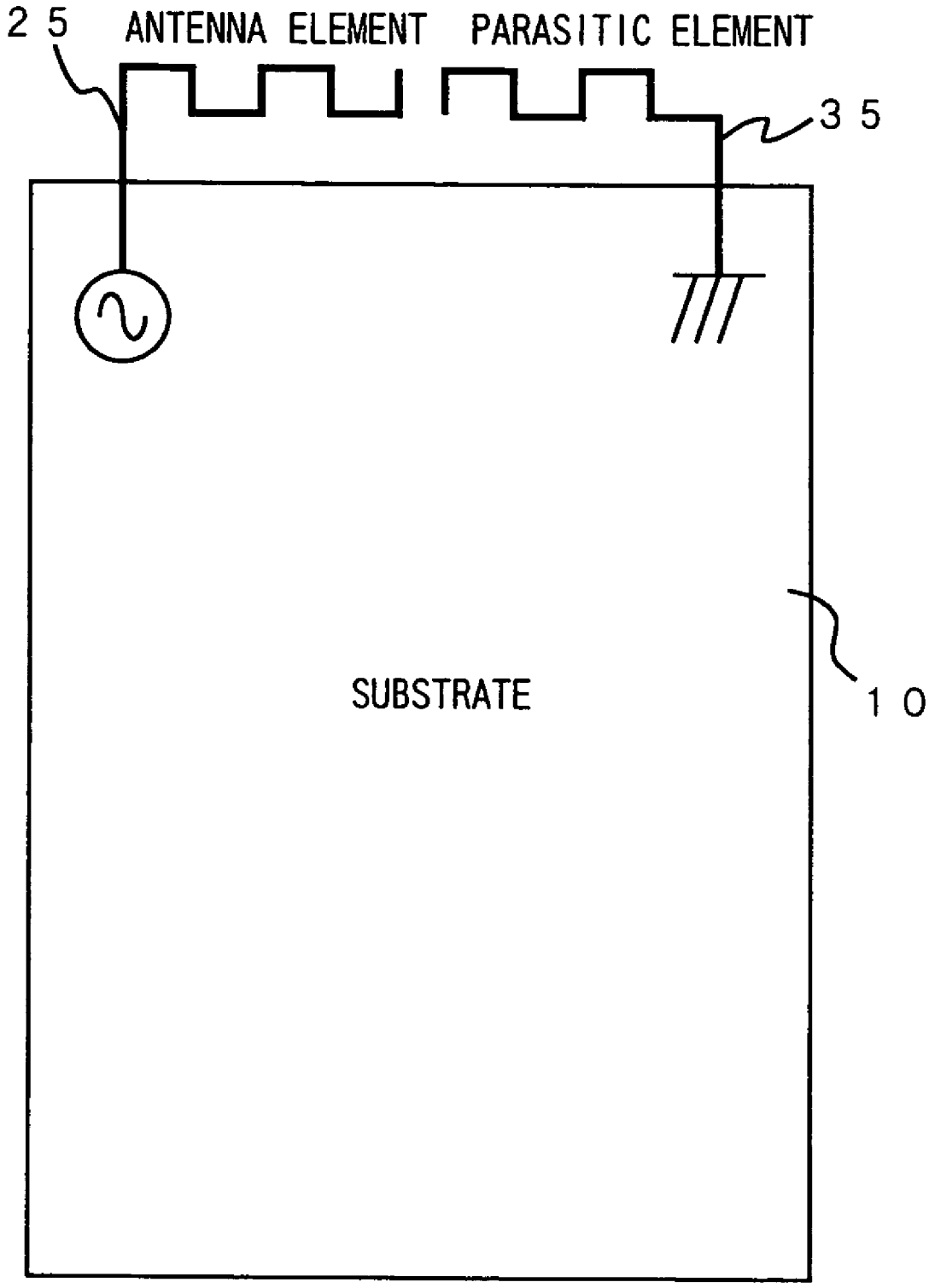
FIG. 11 is a diagram showing another example of the structure of the antenna device according to the fifth embodiment of the present invention.

Incidentally, as shown in FIG. 11, there is likely the case that the directions of open ends of the antenna element 25 and the parasitic element 35 are not the same. In this case, if the antenna element 25 and the parasitic element 35 are capacity coupled, it is possible to have the usual effects of the case that the open ends face to the same direction.

The antenna device of this embodiment, same as that of the first embodiment, has approximately uniform field emission pattern characteristic in all directions, and therefore, the antenna device of this embodiment has applicability to a portable radio terminal.

Figure 12:
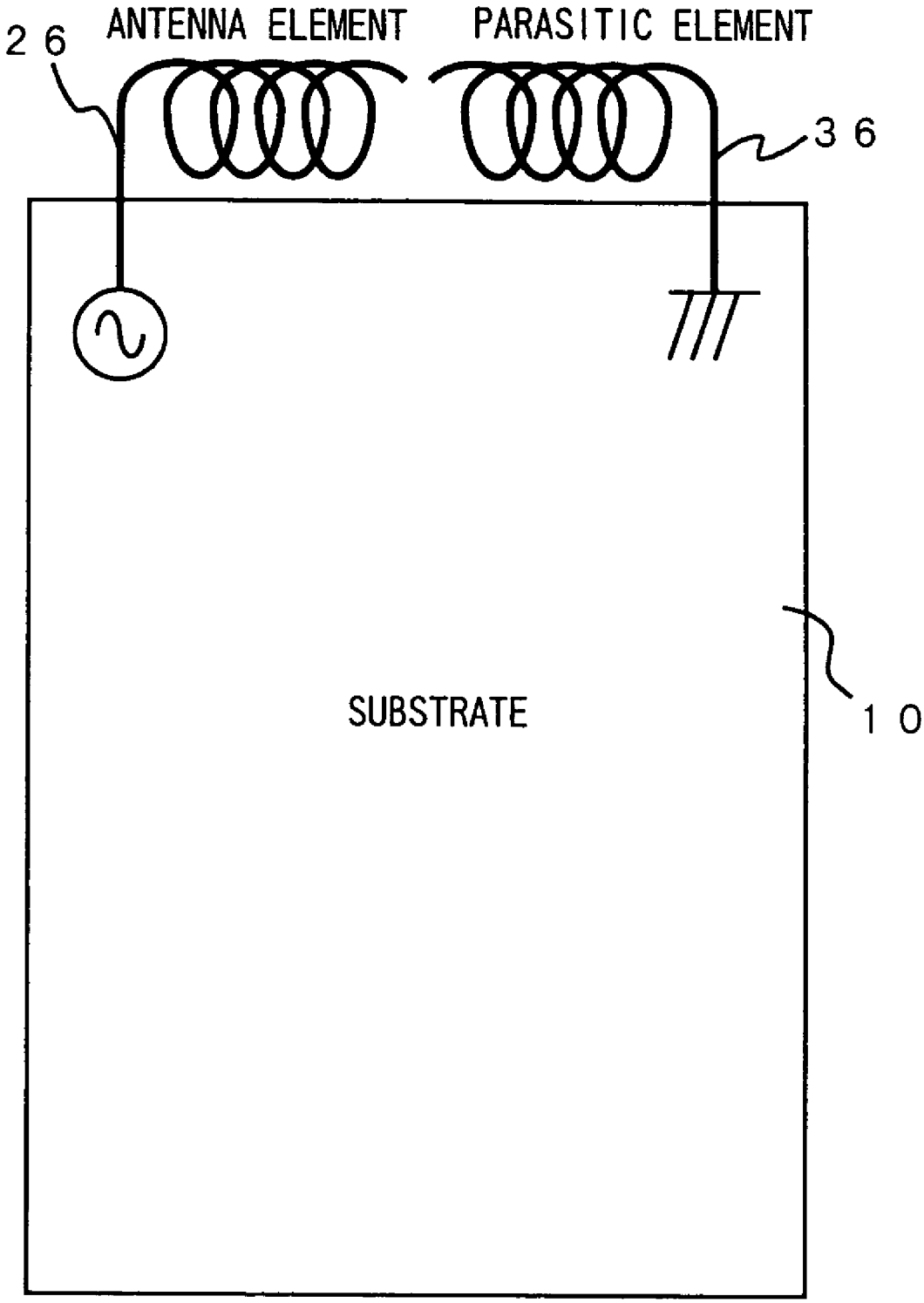
FIG. 12 is a diagram showing the structure of an antenna device according to the sixth embodiment of the present invention.

A description will be given of the sixth embodiment of the present invention. FIG. 12 is a diagram showing the structure of an antenna device of this embodiment. In the antenna device, the antenna element 26 and the parasitic element 36 are attached on one end of the substrate 10. At least one point of one end of the antenna element 26 is electrically connected to a signal wiring pattern on the substrate 10 and also a ground pattern, and the other end of the antenna element 26 is an open end. One end of the parasitic element 36 is connected to the ground of the substrate 10 and the other end of the parasitic element 36 is an open end.

The antenna element 26 and the parasitic element 36 are configured with L-shaped (reverse L-shaped) coiled conductors and both open ends are disposed in close proximity to each other.

When the antenna element 26 and the parasitic element 36 are coiled-shaped, it is possible to lower their natural resonance frequencies. Therefore, the antenna device functions effectively as antenna over such low frequencies as the length of the antenna element 26 or the parasitic element 36 is equal to or less than $\lambda/4$ with respect to the wavelength $\lambda$.

When the open ends of the antenna element 26 and the parasitic element 36 are disposed in close proximity to each other, as is the case with the antenna device of the first embodiment, high-frequency loop current passes through the ground of the substrate 10, the antenna element 26 and the parasitic element 36, and operates in the same manner as that of a loop antenna.

The antenna device of this embodiment, same as that of the first embodiment, has approximately uniform field emission pattern characteristic in all directions, and therefore, the antenna device of this embodiment has applicability to a portable radio terminal.

Figure 13:
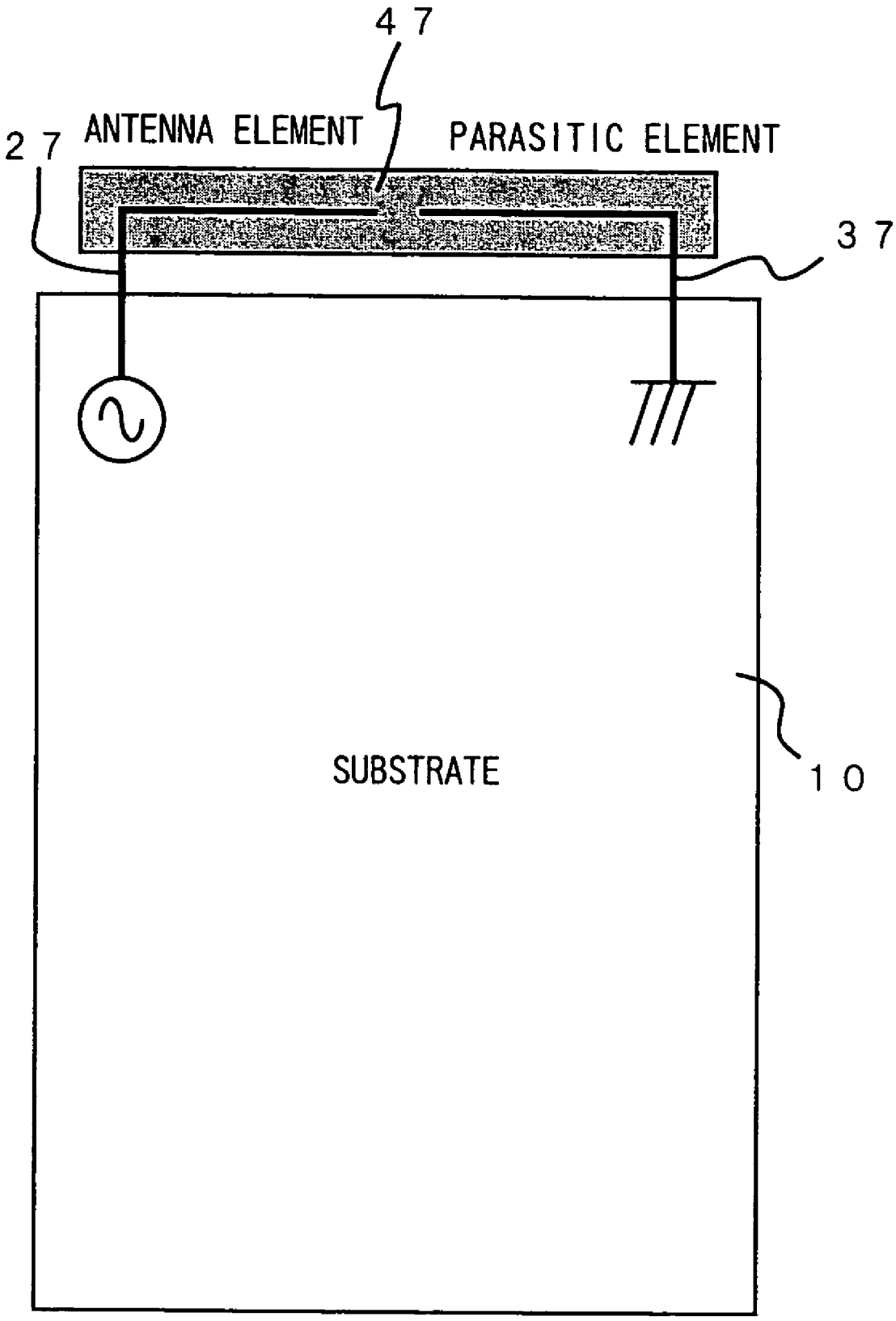
FIG. 13 is a diagram showing the structure of an antenna device according to the seventh embodiment of the present invention.
Figure 14:
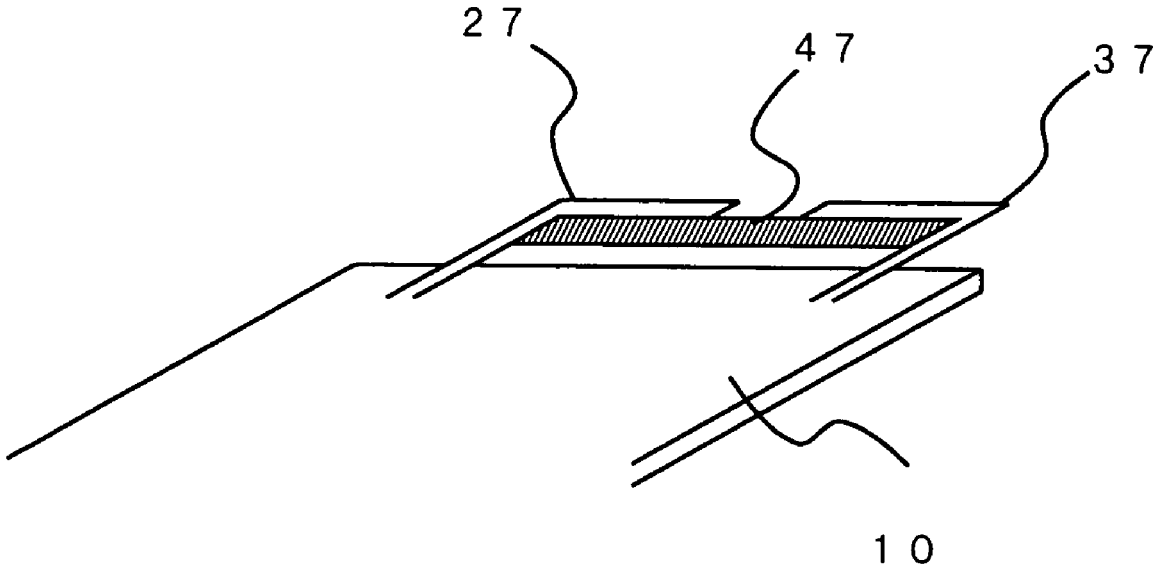
FIG. 14 is a diagram showing a disposition example of high dielectric material in the antenna device according to the seventh embodiment of the present invention.

A description will be given of the seventh embodiment of the present invention. FIG. 13 is a diagram showing the structure of an antenna device of this embodiment. In the antenna device, the antenna element 27 and the parasitic element 37 are attached on one end of the substrate 10. At least one point of one end of the antenna element 27 is electrically connected to a signal wiring pattern on the substrate 10 and the other end of the antenna element 27 is an open end. One end of the parasitic element 37 is connected to the ground of the substrate 10 and the other end of the parasitic element 37 is an open end.

The antenna element 27 and the parasitic element 37 are substantially L-shaped or reverse L-shaped and the open ends are in close proximity to each other in alignment. A high dielectric material 47 is disposed, by being stuck or formed around the antenna element 27 and the parasitic element 37.

Although the high dielectric material 47 can be disposed at an arbitrary place in the vicinity of the antenna element 27 and the parasitic element 37, it is desirable to dispose between the substrate 10 and the ends of the antenna element 27 and the parasitic element 37 as shown in FIG. 13.

When the high dielectric material 47 is disposed between the antenna element 27 and the parasitic element 37, it is possible to lower their natural resonance frequencies. Therefore, the antenna device functions effectively as antenna over such low frequencies as the length of the antenna element 27 or the parasitic element 37 is equal to or less than $\lambda/4$ with respect to the wavelength $\lambda$.

When the open ends of the antenna element 27 and the parasitic element 37 are disposed in close proximity to each other, as is the case with the antenna device of the first embodiment, high-frequency loop current passes through the ground of the substrate 10, the antenna element 27 and the parasitic element 37, and operates in the same manner as that of a loop antenna.

The antenna device of this embodiment, same as that of the first embodiment, has approximately uniform field emission pattern characteristic in all directions, and therefore, the antenna device of this embodiment has applicability to a portable radio terminal.

Figure 15:
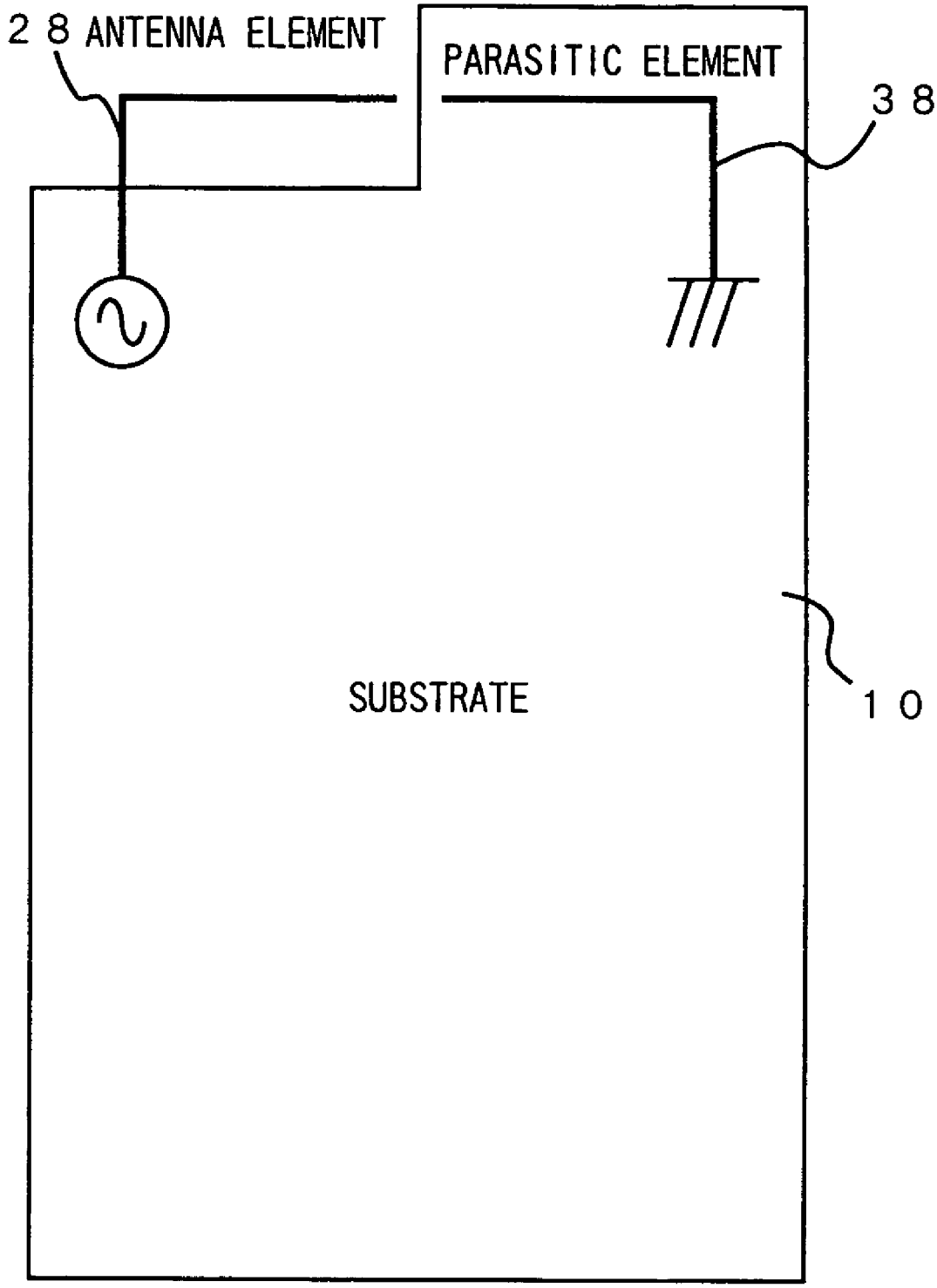
FIG. 15 is a diagram showing the structure of an antenna device according to the eighth embodiment of the present invention.

A description will be given of the eighth embodiment of the present invention. FIG. 15 is a diagram showing the structure of an antenna device of this embodiment. In the antenna device, the antenna element 28 is attached on one end of the substrate 10. At least one point of one end of the antenna element 28 is electrically connected to a signal wiring pattern on the substrate 10 and the other end of the antenna element 28 is an open end. On the substrate 10, a substantially L-shaped (or reverse L-shaped) ground wiring pattern is formed and configures the parasitic element 38. One end of the parasitic element 38 is an open end.

When the open ends of the antenna element 28 and the parasitic element 38 are disposed in close proximity to each other, as is the case with the antenna device of the first embodiment, high-frequency loop current passes through the ground of the substrate 10, the antenna element 28 and the parasitic element 38, and operates in the same manner as that of a loop antenna.

Incidentally, here, while a description has been given of an example of the case that the parasitic element 38 is configured with the wiring pattern of the substrate 10, it is also possible to configure the antenna element 28 or both of the antenna element 28 and the parasitic element 38 from the wiring pattern.

The antenna device of this embodiment, same as that of the first embodiment, has approximately uniform field emission pattern characteristic in all directions, and therefore, the antenna device of this embodiment has applicability to a portable radio terminal.

Figure 16:
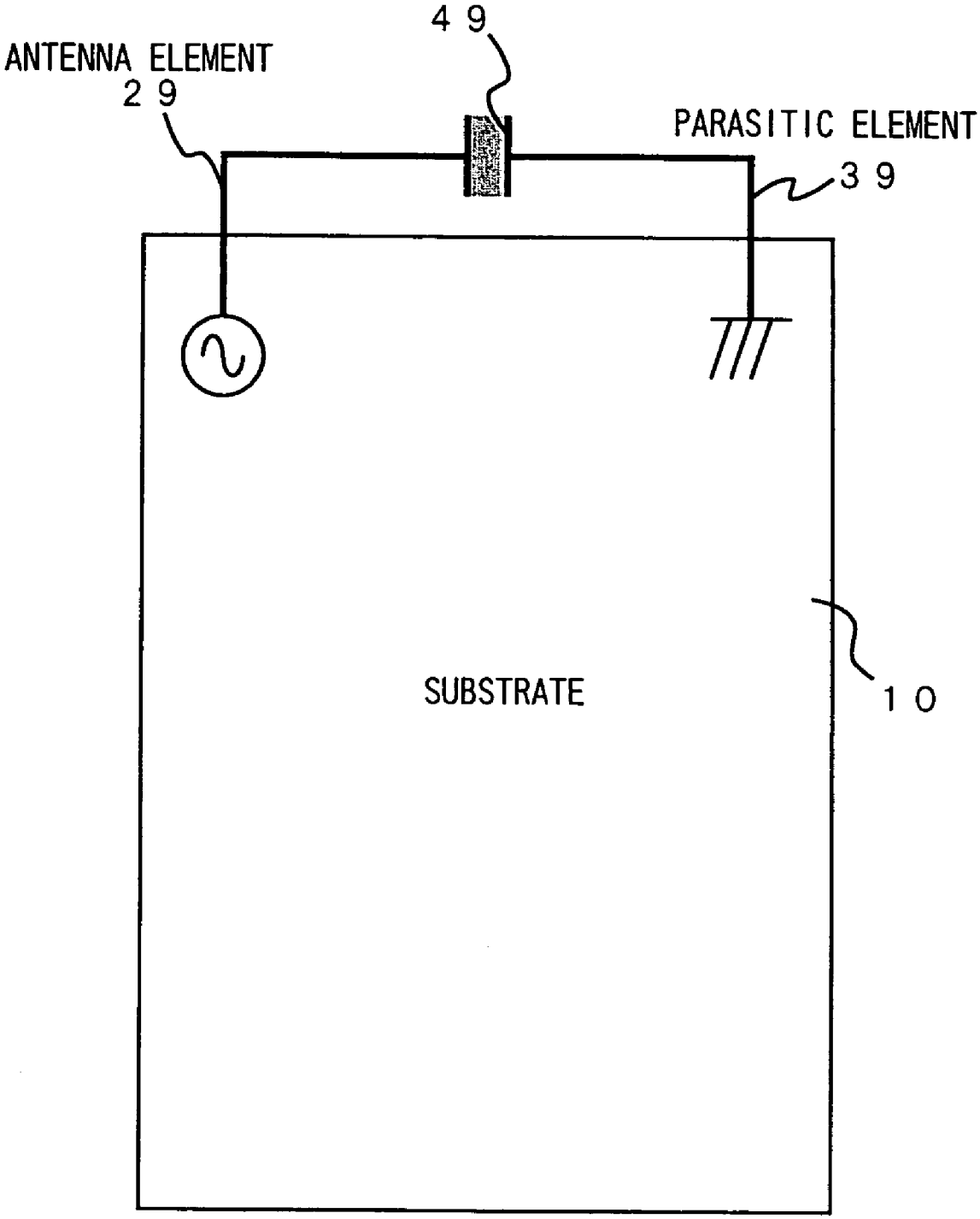
FIG. 16 is a diagram showing the structure of an antenna device according to the ninth embodiment of the present invention.

A description will be given of the ninth embodiment of the present invention. FIG. 16 is a diagram showing the structure of an antenna device of this embodiment. In the antenna device, the antenna element 29 and the parasitic element 39 are attached on one end of the substrate 10. At least one point of one end of the antenna element 29 is electrically connected to a signal wiring pattern on the substrate 10 and the other end of the antenna element 29 is an open end. One end of the parasitic element 39 is connected to the ground of the substrate 10 and the other end of the parasitic element 39 is an open end.

The antenna element 29 and the parasitic element 39 are substantially L-shaped or reverse L-shaped, and a capacitor 49 is formed by both open ends.

When the open ends of the antenna element 29 and the parasitic element 39 are disposed in close proximity to each other, as is the case with the antenna device of the first embodiment, high-frequency loop current passes through the ground of the substrate 10, the antenna element 28 and the parasitic element 38, and operates in the same manner as that of a loop antenna.

The antenna device of this embodiment, same as that of the first embodiment, has approximately uniform field emission pattern characteristic in all directions, and therefore, the antenna device of this embodiment has applicability to a portable radio terminal.

Further, since the degree of capacity coupling of the capacitor 49 formed with open ends of the antenna element 29 and the parasitic element 39 can be forcibly adjusted, a desirable antenna characteristic can be easily made. In other words, even if the respective ends of the antenna element 29 and the parasitic element 39 cannot approximate each other enough to be capacity coupled by a desirable capacitance value, by disposing capacitive element on the respective ends of the antenna element 29 and the parasitic element 39, the antenna element 29 and the parasitic element 39 are capacity coupled by a desirable capacitance value.

Incidentally, when the antenna element 29 and the parasitic element 39 are capacity coupled by equal to or more than a desirable capacitance value, by disposing an inductive element at the ends of the antenna element 29 and the parasitic element 39, the antenna element 29 and the parasitic element 39 are forcibly capacity coupled by a desirable capacitance value.

Figure 17:
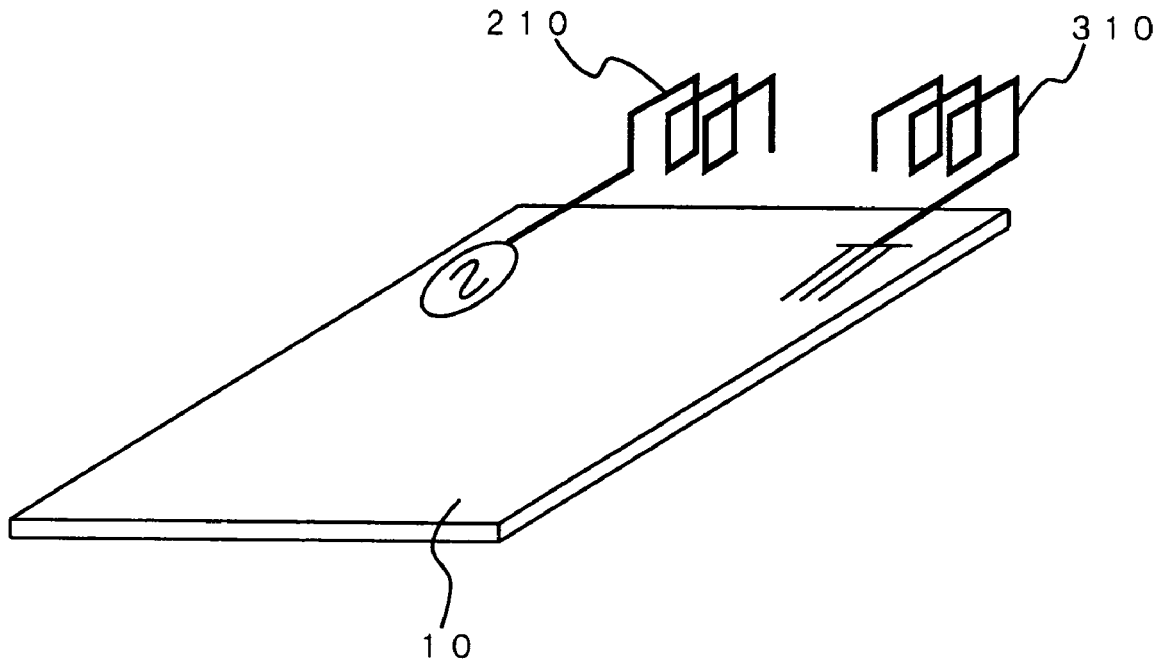
FIG. 17 is a diagram showing the structure of an antenna device according to the tenth embodiment of the present invention.

A description will be given of the tenth embodiment of the present invention. FIG. 17 is a diagram showing the structure of an antenna device of this embodiment. In the antenna device, the antenna element 210 and the parasitic element 310 are attached on one end of the substrate 10. At least one point of one end of the antenna element 210 is electrically connected to a signal wiring pattern on the substrate 10 and the other end of the antenna element 210 is an open end. One end of the parasitic element 310 is connected to the ground of the substrate 10 and the other end of the parasitic element 310 is an open end.

According to this embodiment, each open end of the antenna element 210 and the parasitic element 310 forms a coiled element being substantially square-shaped in its cross-sectional surface. The coiled element being substantially square-shaped in its cross-sectional surface can form a longer antenna than a coiled element being substantially round in its cross-sectional surface. In other words, because the coiled element being substantially square-shaped in its cross sectional surface has a longer turn length, it is possible to contain an antenna having the longer electrical length in a housing. Thus, it is possible to mount, on the substrate 10, the antenna for transmitting and receiving a low-frequency electromagnetic wave. Incidentally, interior spaces of most of portable radio terminals have substantially rectangular solid shape, and therefore, by forming the coil being substantially square-shaped in its cross-sectional surface, the antenna device can be easily contained in the housing without making a dead space.

Figure 18:
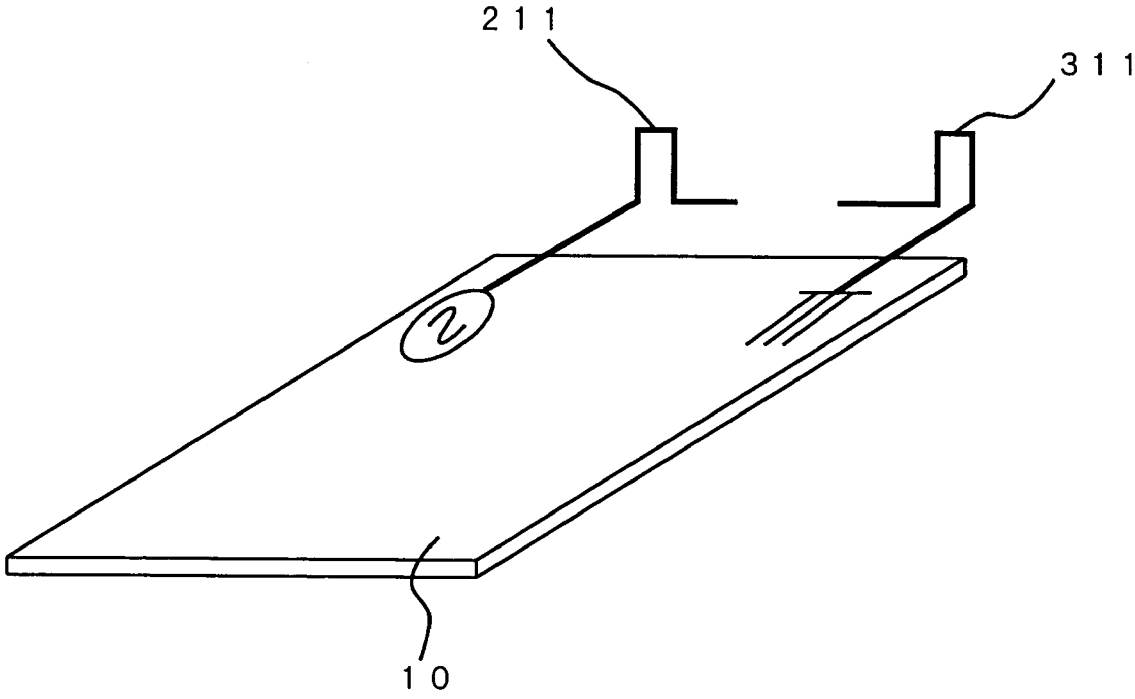
FIG. 18 is a diagram showing the structure of an antenna device according to the eleventh embodiment of the present invention.

A description will be given of the eleventh embodiment of the present invention. FIG. 18 is a diagram showing the structure of an antenna device of this embodiment. In the antenna device, the antenna element 211 and the parasitic element 311 are attached on one end of the substrate 10. At least one point of one end of the antenna element 211 is electrically connected to a signal wiring pattern on the substrate 10 and the other end of the antenna element 211 is an open end. One end of the parasitic element 311 is connected to the ground of the substrate 10 and the other end of the parasitic element 311 is an open end.

According to this embodiment, turn sections (in other words, small number of turned portions) are provided in the vicinity of a feeder end of the antenna element 211 and in the vicinity of a ground end of the parasitic element 311. The open end of each element is linear-shaped, and disposed in close proximity to each other.

The configuration as above is effective in the case where there is a structural restriction, for example, in the case where a hole has to be made in the vicinity of the both open ends (in other words, the midsection of a housing).

Figure 19:
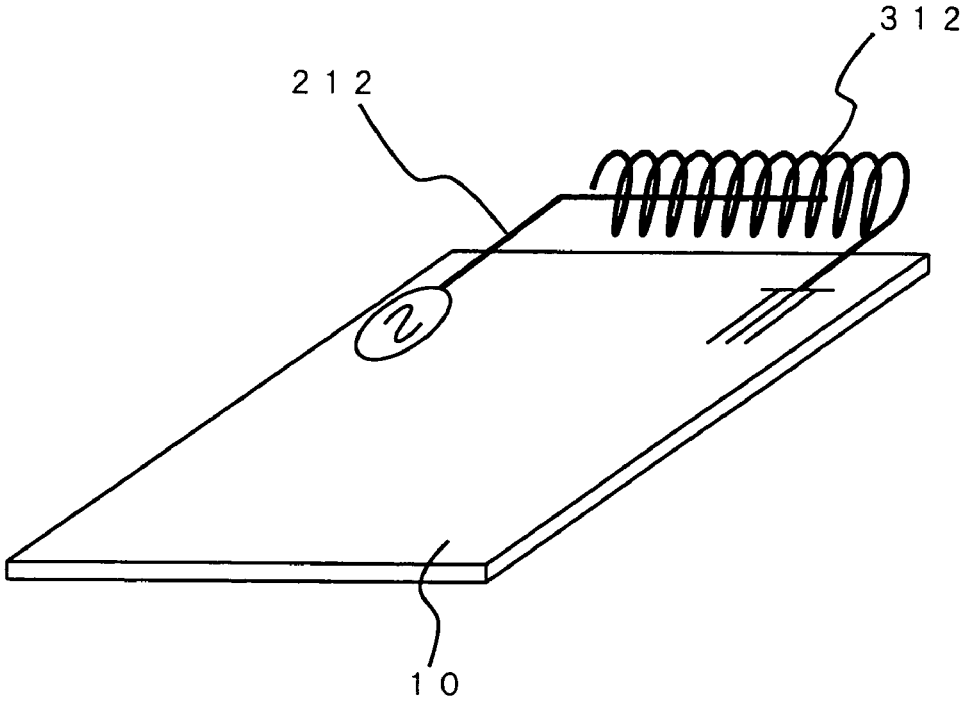
FIG. 19(*a*) is a diagram showing the structure of an antenna device according to the twelfth embodiment of the present invention.
Figure 19:
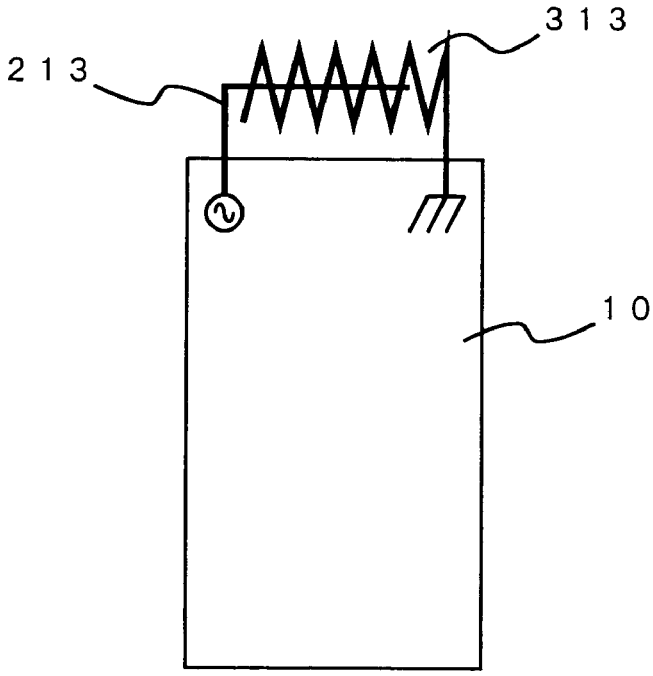

A description will be given of the twelfth embodiment of the present invention. FIG. 19(*a*) is a diagram showing the structure of an antenna device of this embodiment. In the antenna device, the antenna element 212 and the parasitic element 312 are attached on one end of the substrate 10. At least one point of one end of the antenna element 212 is electrically connected to a signal wiring pattern on the substrate 10 and the other end of the antenna element 212 is an open end. One end of the parasitic element 312 is connected to the ground of the substrate 10 and the other end of the parasitic element 312 is an open end.

According to this embodiment, the open end of the parasitic element 312 is coil-shaped, and the open end of the antenna element 212 is linear-shaped. As shown in FIG. 19(*b*), the open end of the antenna element 212 is inserted inside a coil formed by the parasitic element 312.

The configuration as above is effective in the case where a longer coil (element) relative to the antenna device has to be made. In other words, with such structure, the longer coil can be made without expanding the width of the antenna device, and further, both coils (elements) are strongly capacity coupled.

Incidentally, while the open end of the antenna element 212 is linear-shaped and the open end of the parasitic element 312 is coil-shaped as an example, the open end of the antenna element 212 may be coil-shaped and the open end of the parasitic element 312 may be linear-shaped, and the parasitic element 312 may be inserted inside the coil formed by the antenna element 212. Additionally, one of the antenna element 212 and the parasitic element 312 may be coil-shaped having longer outside diameter, and the other element may also be coil-shaped having shorter outside diameter, and the coil having the shorter outside diameter may be inserted inside the coil having the longer outside diameter. Consequently, one of the antenna element 212 and the parasitic element 312 is inserted inside the other element, and thus, the same effect as above can be obtained.

Figure 20:
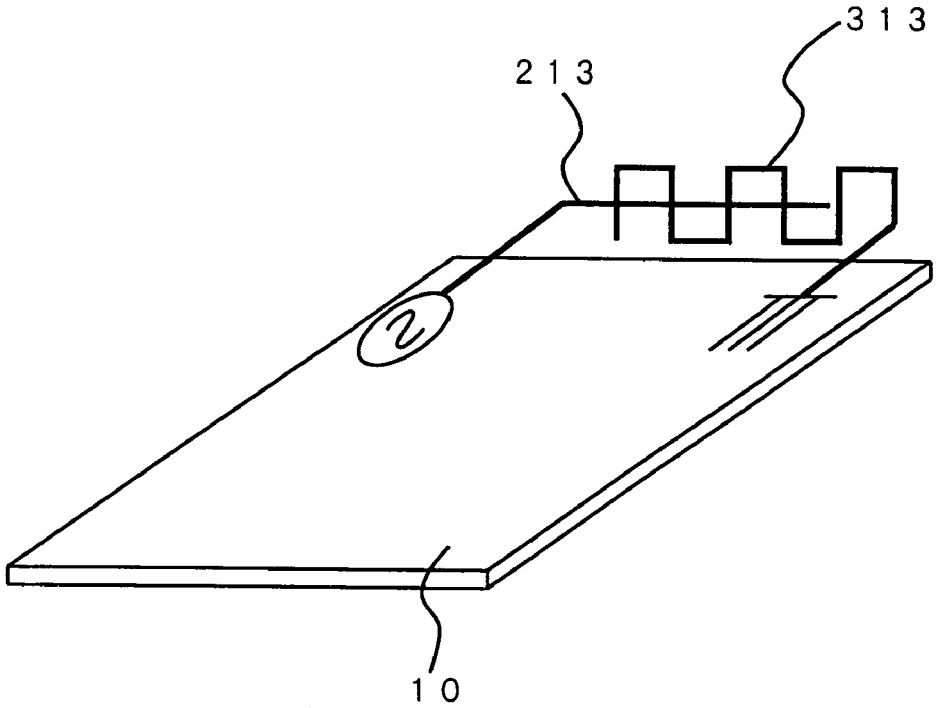
FIG. 20(*a*) is a diagram showing the structure of an antenna device according to the thirteenth embodiment of the present invention.
Figure 20:
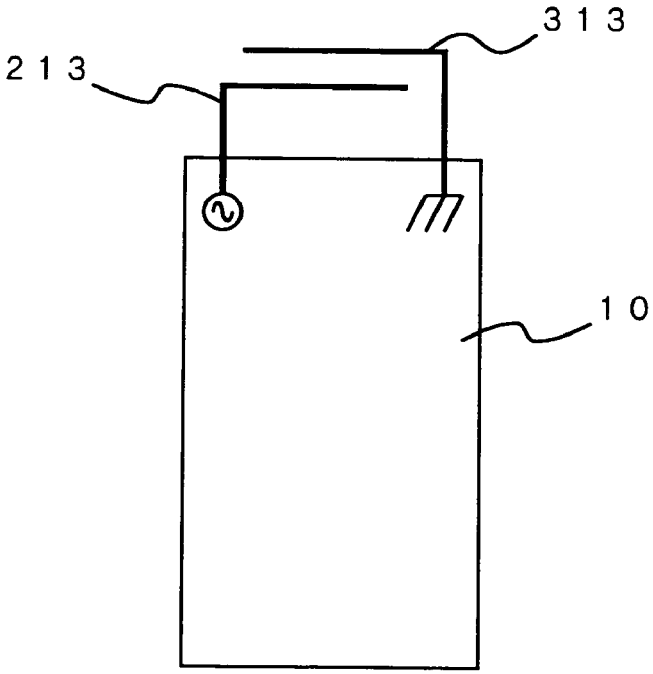

A description will be given of the thirteenth embodiment of the present invention. FIG. 20(*a*) is a diagram showing the structure of an antenna device of this embodiment. In the antenna device, the antenna element 213 and the parasitic element 313 are attached on one end of the substrate 10. At least one point of one end of the antenna element 213 is electrically connected to a signal wiring pattern on the substrate 10 and the other end of the antenna element 213 is an open end. One end of the parasitic element 313 is connected to the ground of the substrate 10 and the other end of the parasitic element 313 is an open end.

According to this embodiment, the open end of the parasitic element 313 is meandering-shaped and vertical to the substrate 10, and the open end of the antenna element 213 is linear-shaped. As shown in FIG. 20(*b*), the antenna element 213 and the parasitic element 313 are disposed substantially parallel to each other in the substantially same plane as the substrate 10.

According to this embodiment, same as the twelfth embodiment, the longer coil can be made without expanding the width of the antenna device, and the antenna element 213 and the parasitic element 313 are strongly capacity coupled. However, differently from the twelfth embodiment, one element is not inserted inside the other element, and thus, each element can be mounted individually on the substrate 10 in a factory. In other words, the antenna element 213 and the parasitic element 313 can be easily mounted on the substrate 10.

While the open end of the antenna element 213 is linear-shaped and the open end of the parasitic element 313 is meandering-shaped as an example, other shapes may be chosen.

Figure 21:
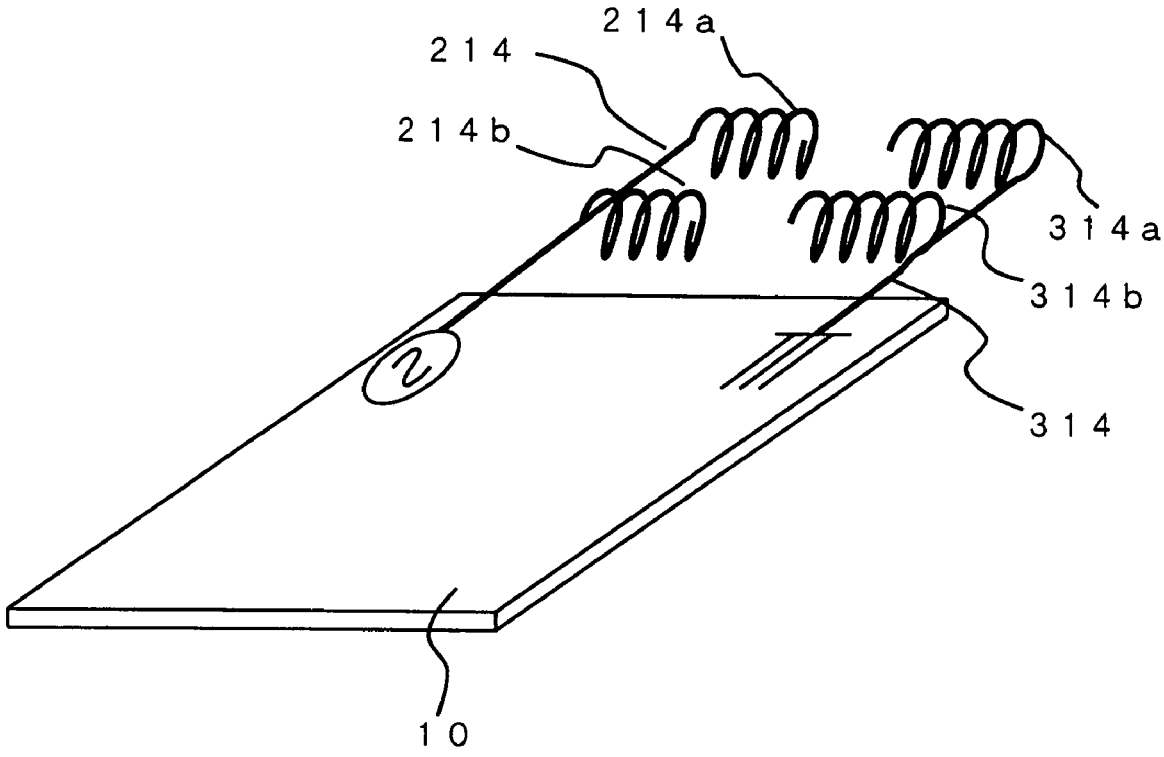
FIG. 21 is a diagram showing the structure of an antenna device according to the fourteenth embodiment of the present invention.

A description will be given of the fourteenth embodiment of the present invention. FIG. 21 is a diagram showing the structure of an antenna device of this embodiment. In the antenna device, the antenna element 214 and the parasitic element 314 are attached on one end of the substrate 10. At least one point of one end of the antenna element 214 is electrically connected to a signal wiring pattern on the substrate 10 and the other end of the antenna element 214 is an open end. One end of the parasitic element 314 is connected to the ground of the substrate 10 and the other end of the parasitic element 314 is an open end.

According to this embodiment, the open end of the antenna element 214 is branched into two parts, and coiled elements (214*a*, 214*b*) are formed in the vicinity of respective ends. The open end of the parasitic element 314 is also branched into two parts, and coiled elements (314*a*, 314*b*) are formed in the vicinity of respective ends.

By forming two or more elements in the antenna element 214 and the parasitic element 314, a multi-resonance antenna or a wideband antenna can be made.

While each of antenna element 214 and parasitic element 314 is provided with two elements by way of example in the structure of this embodiment, three or more elements can of course be provided. Incidentally, the elements are not limited to be coil-shaped. For example, the elements may be meandering-shaped or linear-shaped.

Figure 22:
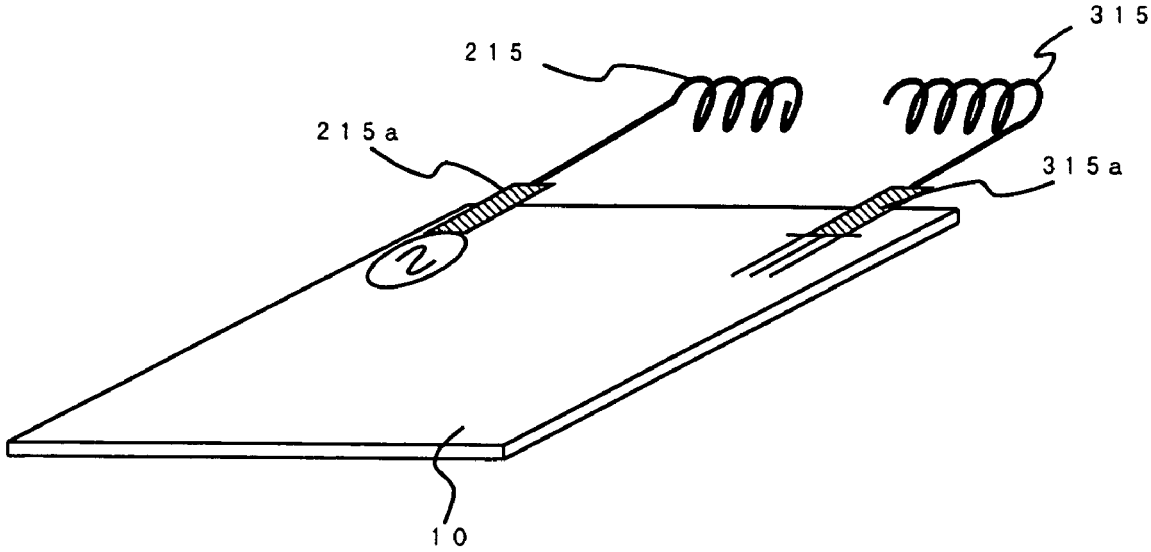
FIG. 22(*a*) is a diagram showing the structure of an antenna device according to the fifteenth embodiment of the present invention.
Figure 22:
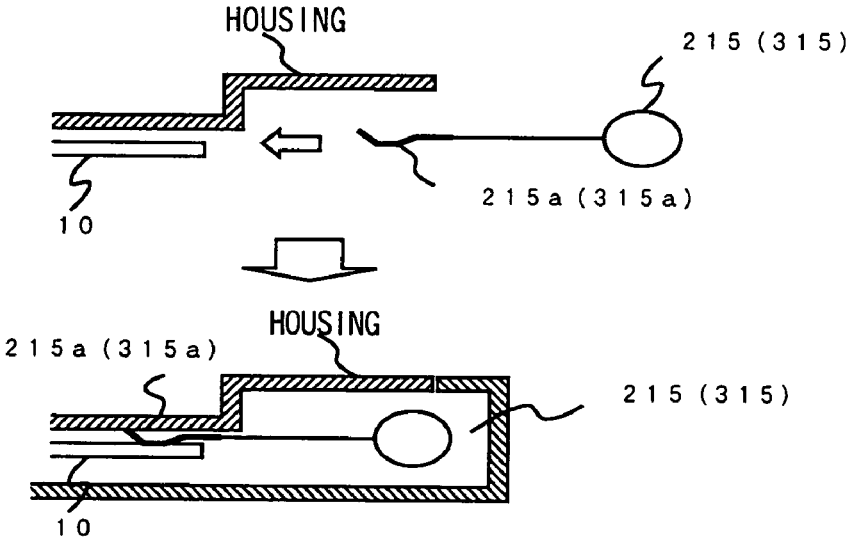

A description will be given of the fifteenth embodiment of the present invention. FIG. 22(*a*) is a diagram showing the structure of an antenna device of this embodiment. In the antenna device, the antenna element 215 and the parasitic element 315 are attached on one end of the substrate 10. At least one point of one end of the antenna element 215 is electrically connected to a signal wiring pattern on the substrate 10 and the other end of the antenna element 215 is an open end. One end of the parasitic element 315 is connected to the ground of the substrate 10 and the other end of the parasitic element 315 is an open end. A contact plate 215*a* is attached at a feeder end of the antenna element 215 and a contact plate 315*a* is attached at a ground end of the parasitic element 315, and each element and each corresponding contact plate are electrically connected. Incidentally, shapes of these elements are voluntarily chosen.

For the respective elements, the contact plates 215*a* and 315*a* are electrical connection points connecting to the substrate 10. In order to obtain electrical connection with the substrate 10, connectors are disposed on the substrate 10 and contact to the contact plates 215*a* and 315*a*. By having the electrical connection through the contact plates 215*a* and 315*a*, the antenna element 215 and the parasitic element 315 are certainly electrically connected to the substrate 10.

Additionally, when the space between the substrate 10 and a housing is too narrow to dispose the connectors on the substrate 10, as shown in FIG. 22(*b*), in order to obtain an electrical connection, one part of each of contact plates 215*a* and 315*a* is formed into a spring shape.

Figure 23:
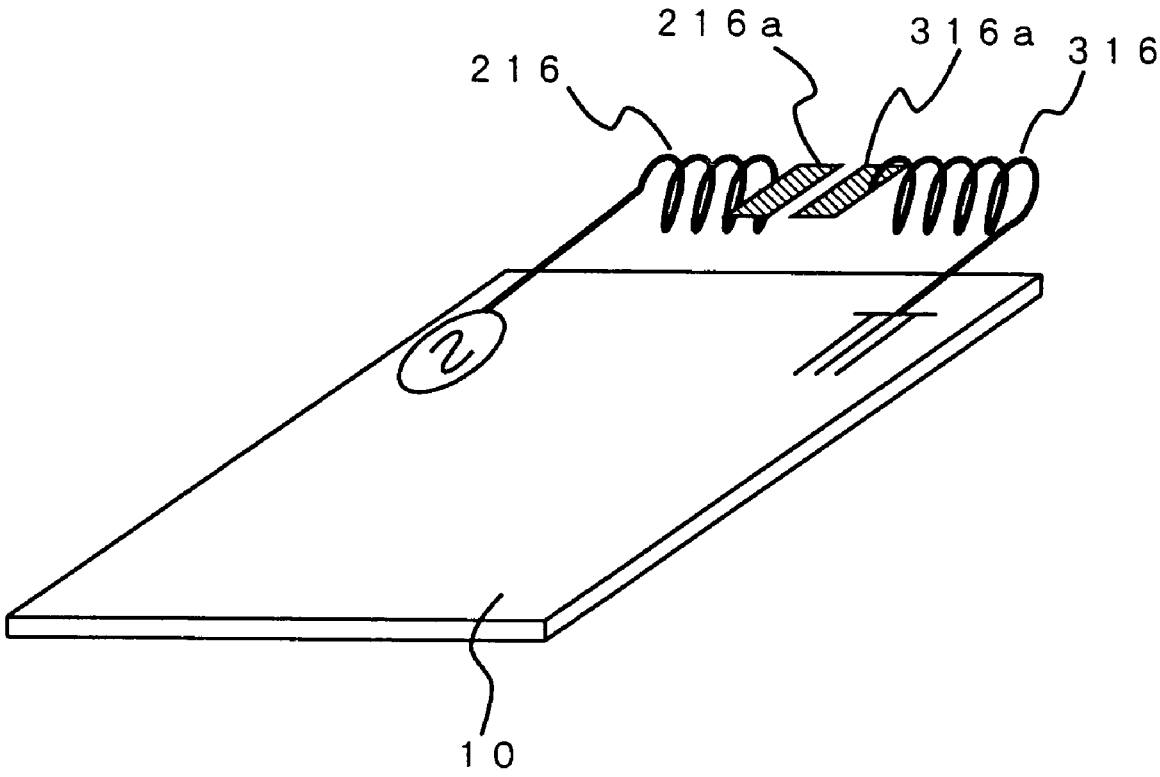
FIG. 23 is a diagram showing the structure of an antenna device according to the sixteenth embodiment of the present invention.

A description will be given of the sixteenth embodiment of the present invention. FIG. 23 is a diagram showing the structure of an antenna device of this embodiment. In the antenna device, the antenna element 216 and the parasitic element 316 are attached on one end of the substrate 10. At least one point of one end of the antenna element 216 is electrically connected to a signal wiring pattern on the substrate 10 and the other end of the antenna element 216 is an open end. One end of the parasitic element 316 is connected to the ground of the substrate 10 and the other end of the parasitic element 316 is an open end. An open end plate 216*a* is attached at the top of the open end of the antenna element 216 and an open end plate 316*a* is attached at the top of the open end of the parasitic element 316, and each element and each corresponding open end plate are electrically connected. Incidentally, shapes of these elements are voluntarily chosen.

When the space between each top of the elements is the same, the elements are more strongly capacity coupled with the open end plates 216*a* and 316*a*. Therefore, even in the case where a space must be made (the open ends cannot be approximated) by the structural reason, the elements are capacity coupled by a desirable capacitance value with the open end plates, and therefore better antenna characteristic is obtained.

Figure 24:
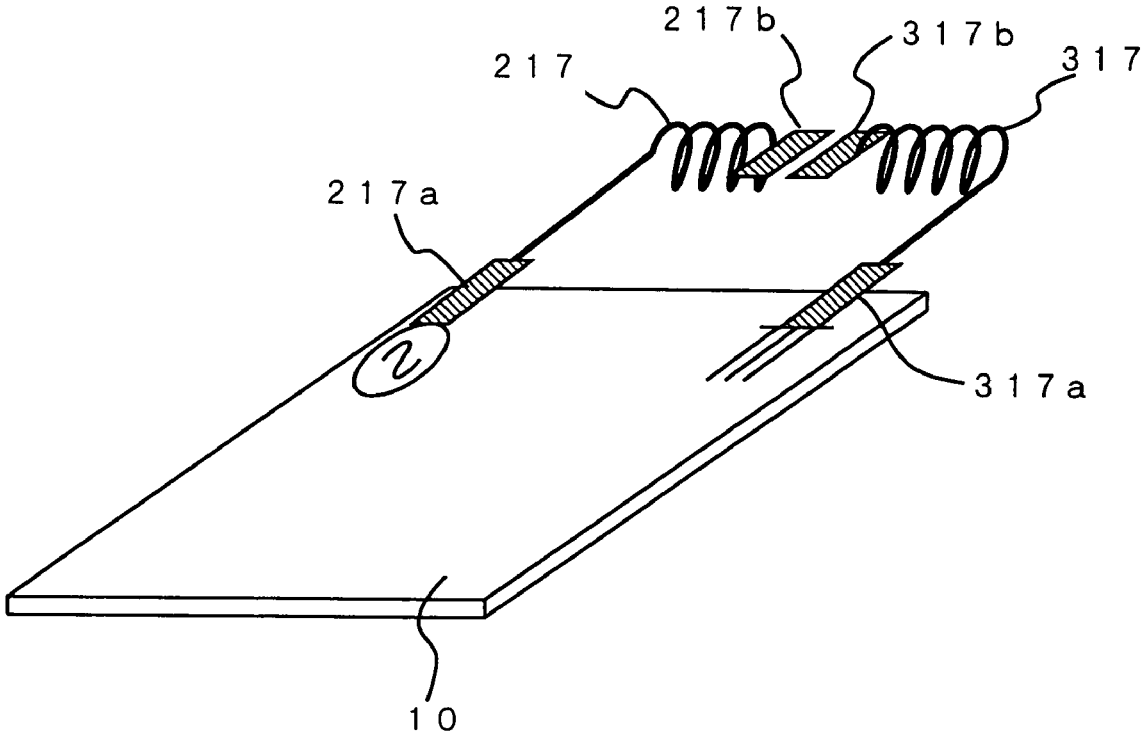
FIG. 24 is a diagram showing the structure of an antenna device according to the seventeenth embodiment of the present invention.

A description will be given of the seventeenth embodiment of the present invention. FIG. 24 is a diagram showing the structure of an antenna device of this embodiment. In the antenna device, the antenna element 217 and the parasitic element 317 are attached on one end of the substrate 10. At least one point of one end of the antenna element 217 is electrically connected to a signal wiring pattern on the substrate 10 and the other end of the antenna element 217 is an open end. One end of the parasitic element 317 is connected to the ground of the substrate 10 and the other end of the parasitic element 317 is an open end. A contact plate 217*a* is attached at a feeder end of the antenna element 217 and a contact plate 317*a* is attached at a ground end of the parasitic element 317, and each element and each corresponding contact plate are electrically connected. An open end plate 217*b* is attached at the top of the open end of the antenna element 217 and an open end plate 317*b* is attached at the top of the open end of the parasitic element 317, and each element and each corresponding open end plate are electrically connected. Incidentally, shapes of these elements are voluntarily chosen.

The antenna device of this embodiment has both advantages of the antenna devices of the fifteenth embodiment and the sixteenth embodiment. Overlapping explanation of each advantage is omitted here.

Figure 25:
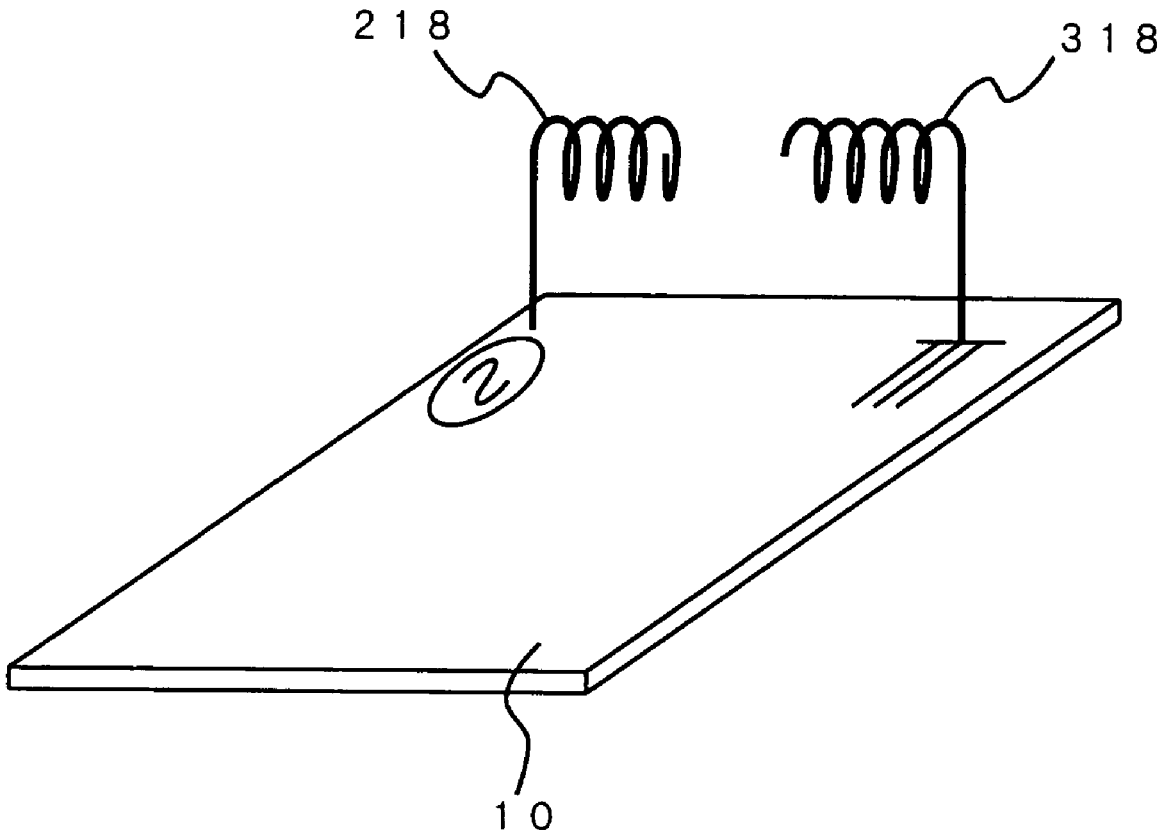
FIG. 25 is a diagram showing the structure of an antenna device according to the eighteenth embodiment of the present invention.

A description will be given of the eighteenth embodiment of the present invention. FIG. 25 is a diagram showing the structure of an antenna device of this embodiment. In the antenna device, the antenna element 218 and the parasitic element 318 are attached in the vicinity of one end of the substrate 10. The antenna element 218 is electrically connected to a signal wiring pattern at a feeder end being in the vicinity of one end of the substrate 10 and the other end of the antenna element 218 is an open end. One end of the parasitic element 318 is connected to the ground of the substrate 10 and the other end of the parasitic element 318 is an open end.

Each part of the antenna element 218 and the parasitic element 318 is lengthened from a feeder end and a ground end respectively in the substantially vertical direction relative to the substrate 10, and both elements are disposed within the projection plane of the substrate 10.

With such structure, it is possible to obtain a good antenna characteristic even when the substrate 10 and the elements cannot be disposed on the substantially same plane in close proximity to each other in a housing.

Figure 26:
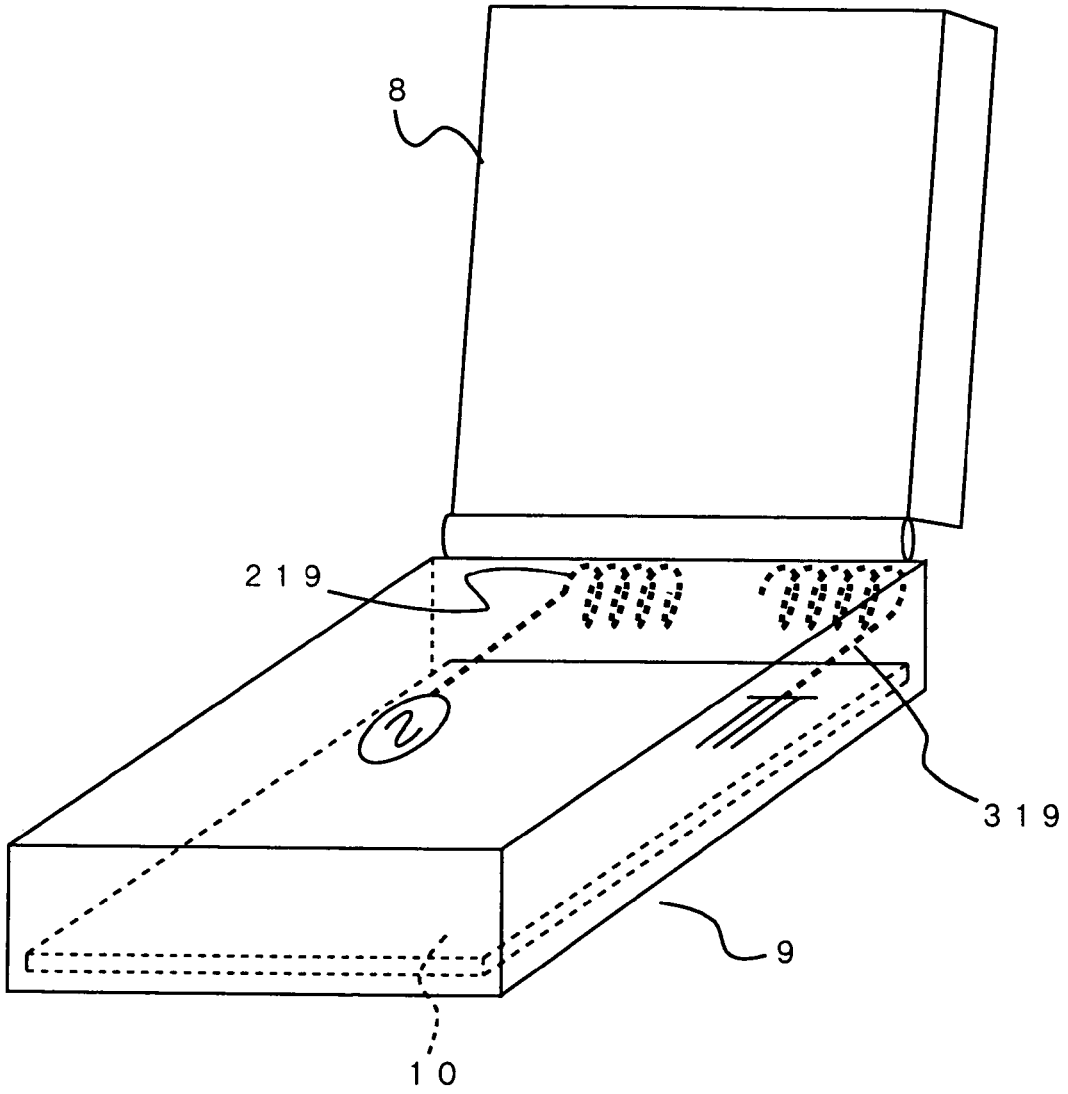
FIG. 26 is a diagram showing the structure of an antenna device according to the nineteenth embodiment of the present invention.

A description will be given of the nineteenth embodiment of the present invention. FIG. 26 is a diagram showing the structure of an antenna device of this embodiment. A terminal to which the antenna device of this embodiment is applied is assembled by connecting two housings (an upper housing 8 and a lower housing 9) by a conjunction mechanism (such as a hinge, a slide mechanism). Incidentally, while the antenna element 219 and the parasitic element 319 whose elements are coil-shaped are shown in the figure, the same shapes of the elements as the above described embodiments may also be applied.

As shown in FIG. 26, the antenna device is disposed so that the elements are in the vicinity of a conjunction section of the two housings. With this structure, when the terminal is closed, the antenna element 219, the parasitic element 319 and the upper housing 8 are apart from each other, and therefore a good antenna characteristic can be obtained. On the other hand, when the terminal is opened, the antenna element 219, the parasitic element 319 and the upper housing 8 are in close proximity with each other, and therefore the antenna characteristic becomes lower in comparison with the closed terminal. Thus, the antenna device of this embodiment is better applied to the portable radio terminal, which is often used in the closed condition.

Figure 27:
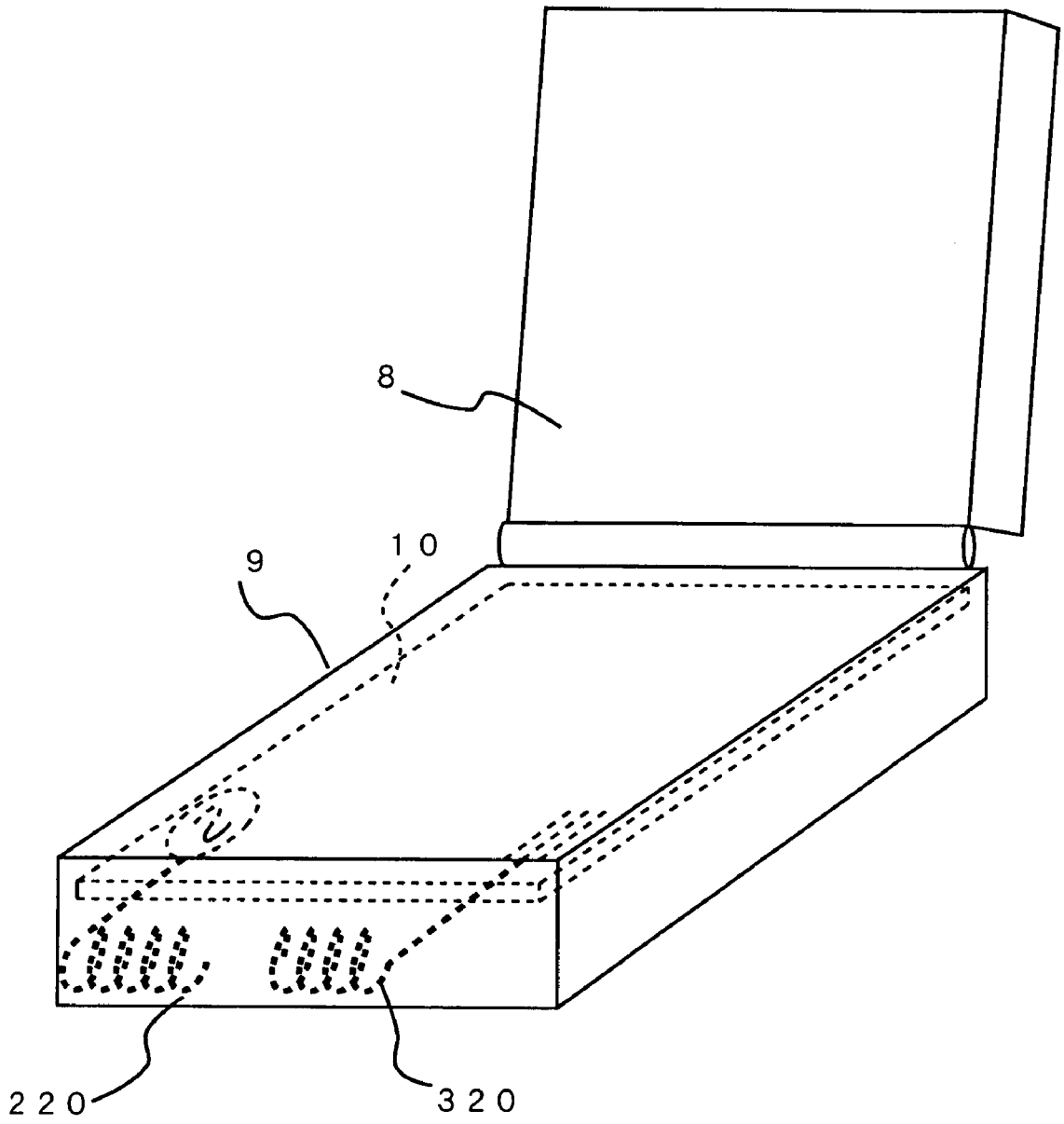
FIG. 27 is a diagram showing the structure of an antenna device according to the twentieth embodiment of the present invention.

A description will be given of the twentieth embodiment of the present invention. FIG. 27 is a diagram showing the structure of an antenna device of this embodiment. A terminal to which the antenna device of this embodiment is applied is assembled by connecting two housings (an upper housing 8 and a lower housing 9) by a conjunction mechanism (such as a hinge, a slide mechanism). Incidentally, while the antenna element 220 and the parasitic element 320 whose elements are coil-shaped are shown in the figure, the same shapes of the elements as the above described embodiments may also be applied.

According to this embodiment, contrary to the nineteenth embodiment, the elements are disposed apart from a conjunction section of the two housings. With this structure, when the terminal is opened, the antenna element 220, the parasitic element 320 and the upper housing 8 are apart from each other, and therefore a good antenna characteristic can be obtained. On the other hand, when the terminal is closed, the antenna element 220, the parasitic element 320 and the upper housing 8 are in close proximity with each other, and therefore the antenna characteristic becomes lower in comparison with the opened terminal. Thus, the antenna device of this embodiment is better applied to the portable radio terminal, which is often used in the opened condition.

Figure 28:
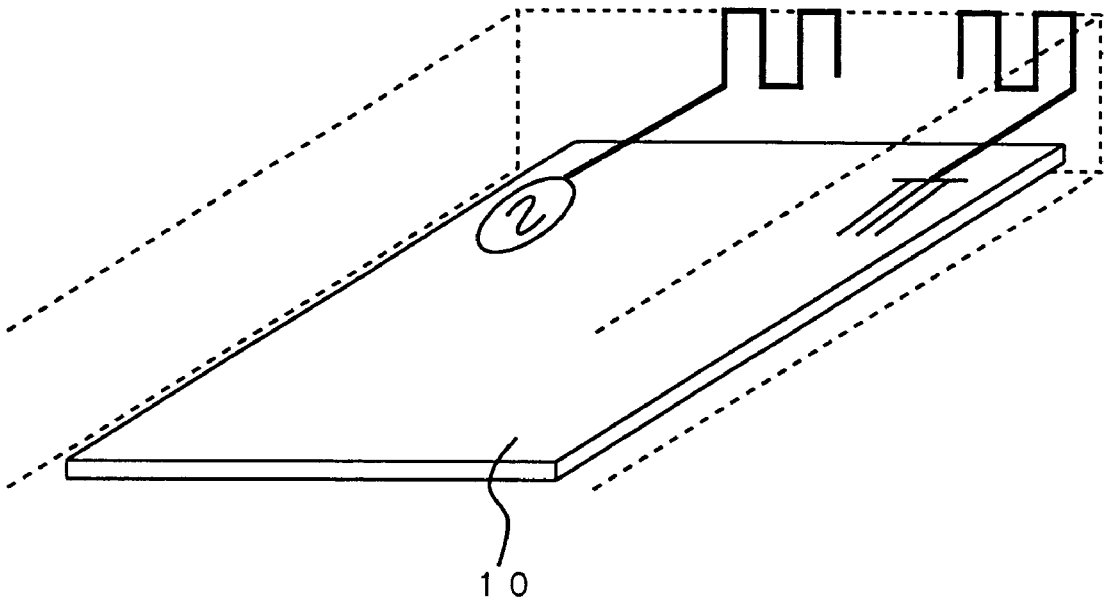
FIG. 28 is a diagram showing the structure of an antenna device according to the twenty-first embodiment of the present invention.

A description will be given of the twenty-first embodiment of the present invention. FIG. 28 is a diagram showing the structure of an antenna device of this embodiment. According to the structure of the antenna device of this embodiment, the elements are disposed alongside an interior surface of a housing.

With this structure, the distance between the substrate 10 and the elements can be secured as long in the housing as possible, and a better antenna characteristic can be obtained. Incidentally, the shape of the elements is voluntarily chosen and the same shapes of the elements as the above described embodiments may also be applied.

According to the present invention, it is possible to provide an antenna device capable of being applied to a portable radio terminal and showing a good antenna characteristic regardless of direction, and a portable radio terminal provided with the antenna device.

While preferred embodiments of the present invention have been described using specific terms, the description has been for illustrative purpose only. For example, while the antenna element is substantially L-shaped or substantially F-shaped in the above described embodiments, any shape can be applied as long as the antenna element and the parasitic element can be capacity coupled.

As above, changes and variations of the present invention may be made without departing from the spirit or scope of the following claims.

What is claimed is:

1. An antenna device applied to a portable radio terminal whose housing length is equal to or more than $\lambda/4$ with respect to the wavelength $\lambda$ of transmission-reception signals comprising:

an antenna element disposed on one end of the housing in the longitudinal direction in which at least one point of one end is connected to a signal wiring pattern on a substrate and the other end is an open end; and a parasitic element disposed on the same side of the housing as the antenna element in which one point of one end is connected to a ground wiring on the substrate and the other end is an open end;

wherein the open end of the antenna element and the open end of the parasitic element are approximated each other and capacity coupled, and the antenna element, the parasitic element and the substrate are disposed forming a loop generating a loop current, wherein the loop current flows in a first direction between the substrate and the antenna element, and the loop current flows in a second direction between the substrate and the parasitic element, wherein the first direction and the second direction are opposite to each other.

2. The antenna device claimed in claim 1, wherein: the antenna element is L-shaped or F-shaped; and the parasitic element is reverse L-shaped or I-shaped.

3. The antenna device claimed in claim 1, wherein at least one of the antenna element and the parasitic element is meandering-shaped in the vicinity of the open end.

4. The antenna device claimed in claim 1, wherein at least one of the antenna element and the parasitic element is helical-shaped in the vicinity of the open end.

5. The antenna device claimed in claim 4, wherein the open end of one of the antenna element and the parasitic element is inserted inside the other element whose open end is helical-shaped.

6. The antenna device claimed in claim 1, wherein at least one of the antenna element and the parasitic element is configured with a tabular conductor in the vicinity of the open end.

7. The antenna device claimed in claim 1, wherein:

the open ends of the antenna element and the parasitic element are disposed in substantially the same plane as the substrate; and the distances from the substrate to the open end of the antenna element and to the open end of the parasitic element are different.

8. The antenna device claimed in claim 1, wherein the open ends of the antenna element and the parasitic element are spaced from the substrate.

9. The antenna device claimed in claim 1, wherein at least one of the antenna element and the parasitic element has two or more open ends.

10. The antenna device claimed in claim 9, wherein at least one of the open ends of at least one of the antenna element and the parasitic element is meandering-shaped.

11. The antenna device claimed in claim 9, wherein at least one of the open ends of at least one of the antenna element and the parasitic element is helical-shaped.

12. The antenna device claimed in claim 11, wherein at least one of the open ends of one of the antenna element and the parasitic element is inserted inside the other element whose open end is helical-shaped.

13. The antenna device claimed in claim 9, wherein at least one of the open ends of at least one of the antenna element and the parasitic element is configured with a tabular conductor.

14. The antenna device claimed in claim 9, wherein:

the open ends of the antenna element and the parasitic element are disposed in substantially the same plane as the substrate; and the distances from the substrate to the open end of the antenna element and to the open end of the parasitic element are different.

15. The antenna device claimed in claim 9, wherein the open ends of the antenna element and the parasitic element are spaced from the substrate.

16. The antenna device claimed in claim 1, wherein connecting sections of the antenna element and the parasitic element to the substrate are platy.

17. The antenna device claimed in claim 1, wherein the open ends of the antenna element and the parasitic element are platy.

18. The antenna device claimed in claim 1, wherein a high dielectric material is disposed around the antenna element and the parasitic element.

19. The antenna device claimed in claim 1, wherein at least one of the antenna element and the parasitic element is configured with the signal wiring pattern on the substrate.

20. The antenna device claimed in claim 1, wherein a capacitive element or an inductive element is disposed between the open end of the antenna element and the open end of the parasitic element.

21. A portable radio terminal provided with the antenna device claimed in claim 1.

22. The portable radio terminal claimed in claim 21, wherein two housings are joined by a conjunction mechanism to be openable and closable.

23. The portable radio terminal claimed in claim 22, wherein the antenna element and the parasitic element contained in the housing are disposed in the vicinity of the conjunction mechanism.

24. The portable radio terminal claimed in claim 22, wherein the antenna element and the parasitic element contained in the housing are disposed at the place most distant from the conjunction mechanism.

25. The portable radio terminal claimed in claim 22, wherein the antenna element and the parasitic element contained in the housing are disposed alongside of an interior surface of the housing.

* * * * *